United States Patent [19]

Yamashita et al.

[11] Patent Number: 4,554,247

[45] Date of Patent: Nov. 19, 1985

[54] SILVER HALIDE PHOTOGRAPHIC MATERIAL

[75] Inventors: Kiyotoshi Yamashita, Hachioji; Minoru Ishikawa, Fussa; Hideo Ohta; Kenji Kumashiro, both of Hachioji, all of Japan

[73] Assignee: Konishiroku Photo Industry Co., Ltd., Japan

[21] Appl. No.: 579,765

[22] Filed: Feb. 13, 1984

[30] Foreign Application Priority Data

Feb. 15, 1983 [JP] Japan ..... 58-23609

[51] Int. Cl.[4] ..... G03C 1/30

[52] U.S. Cl. ..... 430/622; 430/623; 430/546; 430/621; 430/631

[58] Field of Search ..... 430/622, 623, 546, 631, 430/621

[56] References Cited

U.S. PATENT DOCUMENTS 4,173,481 11/1979 Sera et al. ..... 430/622

4,217,410 8/1980 Nakamura et al. ..... 430/546

FOREIGN PATENT DOCUMENTS 941998 11/1963 United Kingdom .

*Primary Examiner*—Won H. Louie

*Attorney, Agent, or Firm*—Finnegan, Henderson, Farabow, Garrett & Dunner

[57] ABSTRACT

A silver halide photographic material having as essential photographic layers at least one photosensitive silver halide emulsion layer and at least one non-sensitive hydrophilic colloidal layer on a support is disclosed. At least one of said photographic layers contains fine oil globules at a density of 1 or more, and a hardener having at least three functional groups is incorporated in at least one photographic layer containing said fine oil globules and/or at least one photographic layer which is farther from said support than the photographic layer containing said fine oil globules.

13 Claims, No Drawings

SILVER HALIDE PHOTOGRAPHIC MATERIAL

BACKGROUND OF THE INVENTION

1. Field of the Invention

The present invention relates to a silver halide photographic material, and more particularly, to a silver halide photographic material having improved image quality.

2. Description of the Prior Art

Silver halide photographic materials (hereunder simply referred to as photographic materials) generally consist of a support such as glass, paper or synthetic resin film having formed thereon photosensitive silver halide emulsion layers, as well as nonsensitive hydrophilic colloidal layers such as a filter layer, an intermediate layer, a protective layer, a subbing layer, a backing layer and an antihalation layer. The thicknesses of the photographic materials vary with the type of the specific photographic material and what constituent layers are used. Color photographic materials using more than 10 constituent layers may exceed 20 microns in thickness.

With the recent development of smaller formats for pictures and with the increasing demand of users for higher image quality, the need for photographic materials having improved image quality is increasing. One proposal for improving the image quality is by decreasing the thickness of each of the layers coated on the photographic support. This technique is considered to be effective for increasing the image sharpness because it reduces not only the optical scattering path but also the diffusion path occurring in the development process. However, this method has its own problem.

The layers formed on the photographic support generally consist of a hydrophilic colloid (binder) having dispersed therein silver halide grains and various additives that suit specific purposes. The additives include water-insoluble compounds such as high-boiling organic solvents, and they are incorporated in the binder in the form of emulsified oil globules. Photographic additives may also be incorporated within these oil globules to achieve various purposes. For example, UV absorbers may be incorporated for the purposes of preventing static buildup or improving the keeping quality. Anti-discoloration agents or anti-oxidants may be incorporated in order to provide improved keeping quality. Other additives that can be incorporated in oil globules are oil-soluble couplers; DIR compounds that react with the oxidation product of a developing agent to release a development retarding compound and form a substantially colorless compound; agents to prevent color mixing; and anti-stain agents.

If the oil globules are present in each constituent layer at a higher density than the binder, they coalesce in a hot and humid atmosphere and cause "bleeding" that either makes the surface of the layer sticky or may even devitrify the surface of the photographic material.

A method is shown in Japanese Patent Publication No. 8346/81 for minimizing the "bleeding" by reducing the density of the oil globules in the outermost photographic layer. However, in order to provide an improved image sharpness, the thickness of each photographic layer must be reduced by using less gelatin, and this increases unavoidably the density of the oil globules. Therefore, this method is not completely effective for preventing the "bleeding".

SUMMARY OF THE INVENTION

Therefore, one object of the present invention is to provide a silver halide photographic material having improved image sharpness and which is reasonably protected against bleeding.

Another object of the present invention is to provide a silver halide photographic material that can be stored in a hot and humid atmosphere for an extended period without losing its high image sharpness.

These objects of the present invention can be attained by a silver halide photographic material having as essential photographic layers at least one photosensitive silver halide emulsion layer and at least one nonsensitive hydrophilic colloidal layer on a support, at least one of said photographic layers containing fine oil globules at a density of 1 or more, and a hardener having at least three functional groups being incorporated in at least one photographic layer containing said fine oil globules and/or at least one photographic layer which is farther from said support than the photographic layer containing said fine oil globules.

DETAILED DESCRIPTION OF THE PREFERRED EMBODIMENTS

Any silver halide photographic material can be used in the present invention so long as it has on a support at least one photosensitive silver halide emulsion layer and at least one nonsensitive hydrophilic colloidal layer as essential photographic layers. There is no upper limit for the maximum number of the photosensitive silver halide emulsion layers and non-sensitive hydrophilic colloidal layers. Furthermore, these photographic layers may be arranged in any order. A typical example is a silver halide photographic material having formed on a suppport at least one unit of photosensitive silver halide emulsion layers having different degrees of photosensitivity to substantially the same color, as well as at least one nonsensitive hydrophilic colloidal layer. The unit of sensitive layers has sensitivity to blue, green or red light, and even a multi-layer silver halide color photographic material capable of general color reproduction is included in the category of the silver halide photographic material of the present invention. A multi-layer silver halide color photographic material generally consists of a support coated with a sequence of red-, green- and blue-sensitive layers, the red-sensitive layer being the closest to the support. This order may be reversed or modified in various ways. Units of photosensitive layers may optionally be interposed with nonsensitive hydrophilic colloidal layers such as filter layers or intermediate layers. In each unit, the photosensitive silver halide emulsion layers are typically arranged in such a manner that a layer having the highest sensitivity is disposed the farthest from the support and the sensitivity decreases gradually toward the support. A nonsensitive hydrophilic colloidal layer may be disposed between each photosensitive silver halide emulsion layer.

According to the present invention, the fine oil globules are incorporated in at least one of the photographic layers on the support, and such photographic layer may be a photosensitive silver halide emulsion layer or a nonsensitive hydrophilic colloidal layer. For the purpose of providing an improved image sharpness, a relatively thick sensitive silver halide emulsion layer may be formed of the photographic layer containing the fine oil globules at a density of 1 or more. In this case, the fine oil globules may be incorporated within two or more photosensitive silver halide emulsion layers, as well as within one or more nonsensitive hydrophilic colloidal layer.

The term "fine oil globules" as used hereinafter means discrete and substantially water-insoluble oil droplets finely dispersed in a binder made of a substantially hydrophilic colloidal substance. For the purposes of the present invention, the fine oil globules may have a diameter of 0.01 to 20 microns, and those having an average size of 0.1 to 10 microns are preferred.

The oil globules may be made of various materials such as organic high-boiling compounds, typically used in dispersing photographic couplers, of the type shown in U.S. Pat. Nos. 2,322,027, 2,801,170, 2,801,171, 2,272,191 and 2,304,940; and lubricants, such as sodium salts of higher alkyl sulfates, esters of higher aliphatic acids and higher alcohols (generally referred to as waxes), polyethylene glycols of higher molecular weights, higher alkyl phosphate esters and silicone compounds, of the type shown in U.S. Pat. Nos. 2,882,157, 3,121,060, 3,850,640, and Japanese Patent Application (OPI) No. 141623/76 (the symbol OPI as used hereinafter means an unexamined published Japanese patent application). Also usable as oil globules are those compounds which are solid at room temperature but which turn liquid when they are incorporated in hydrophilic colloidal layers or when photographic additives are incorporated therein. Compounds of this type generally have melting points not higher than 50° C.

Preferred organic high-boiling compounds that form the fine oil globules have boiling points of 180° C. or more. Specific examples include diethyl adipate, dibutyl adipate, diisobutyl adipate, di-n-hexyl adipate, dioctyl adipate, dicyclohexyl azelate, di-2-ethylhexyl azelate, dioctyl sebacate, diisooctyl sebacate, dibutyl succinate, octyl stearate, dibenzyl phthalate, tri-o-cresyl phosphate, diphenyl-mono-p-tert-butylphenyl phosphate, monophenyl-di-o-chlorophenyl phosphate, monobutyl-dioctyl phosphate, 2,4-di-n-amylphenol, 2,4-di-tert-amylphenol, 4-n-nonylphenol, 2-methyl-4-n-octylphenol, N,N-diethylcaprylamide, N,N-diethyllaurylamide, glycerol tripropionate, glycerol tributyrate, glycerol monolactate diacetate, tributyl citrate, acetyl-triethyl citrate, di-2-ethyl-hexyl adipate, dioctyl sebacate, di-isooctyl azelate, diethylene glycol dibenzoate, dipropylene glycol dibenzoate, triethyl citrate, tri(2-ethylhexyl)citrate, acetyl tri-n-butyl citrate, di(isodecyl) 4,5-epoxytetrahydrophthalate, oligovinyl ethyl ether, dibutyl fumarate, polyethylene oxide ($n>16$), glycerol tributyrate, ethylene glycol dipropionate, di(2-ethylhexyl)isophthalate, butyl laurate, tri-(2-ethylhexyl)phosphate, triphenyl phosphate, tricresyl phosphate, silicone oil, dimethyl phthalate, diethyl phthalate, dipropyl phthalate, dibutyl phthalate, diisooctyl phthalate, diamyl phthalate, di-n-octyl phthalate, diamyl naphthalene, triamyl naphthalene, monocaprin, monolaurin, monomyristin, monopalmitin, monostearin, monoolein, dicaprin, dilaurin, dimyristin, dipalmitin, distearin, diolein, 1-stearo-2-palmitin, 1-palmito-3-stearin, 1-palmito-2-stearin, triacetin, tricaprin, trilaurin, trimyristin, tripalmitin, tristearin, triolein, tripetroselin, trierucin, triricinolein, linoleodistearin, linoleodilinolenin, oleodierucin, linoleodierucin, oleopalmitolinolenin, and paraffin; drying oils such as linseed oil, soybean oil, perilla oil, tung oil, hempseed oil, kaya oil, walnut oil, soyasauce oil, poppy seed oil, sunflower oil, kuwai oil and safflower oil; semidrying oils such as cottonseed oil, corn oil, sesame oil, rape oil, rice brain oil, croton oil, kapok oil and dehydrated castor oil; as well as peanut oil, olive oil, tsubaki oil, sasanqua oil, tea seed oil, castor oil, hydrogenated castor oil, almond oil, ben oil, and hydrocarpus oil.

Other suitable organic high-boiling compounds are those which have the formula:

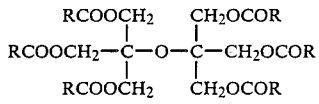

or

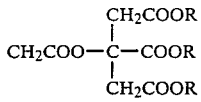

(wherein R is an alkyl group having 1 to 8 carbon atoms).

Among the compounds listed above, esters of glutaric acid, adipic acid, phthalic acid, sebacic acid, succinic acid, maleic acid, fumaric acid, azelaic acid, isophthalic acid, terephthalic acid and phosphoric acid, as well as glycerin esters, and paraffin and fluorinated paraffin are advantageous because they have no adverse effects on the photographic materials, are easily available, and have sufficient chemical stability to ensure ease of handling. Particularly preferred organic high-boiling compounds are tricresyl phosphate, triphenyl phosphate, dibutyl phthalate, di-n-octyl phthalate, di-2-ethylhexyl phthalate, glycerol tributyrate, glycerol tripropionate, dioctyl sebacate, paraffin, fluorinated paraffin and silicone oil.

Any known method can be used to form the fine oil globules suitable for use in the present invention. A typical method proceeds as follows: one or more oil globule forming compounds such as the organic high-boiling compounds are put into solution, optionally together with photographic additives to be described hereinafter; if necessary, they are dissolved in low-boiling solvents (which may be used either alone or in combination) such as methyl acetate, ethyl acetate, propyl acetate, butyl acetate, butyl propionate, cyclohexanol, diethylene glycol monoacetate, nitromethane, carbon tetrachloride, chloroform, cyclohexane tetrahydrofuran, methyl aclohol, ethyl alcohol, propyl alcohol, fluorinated alcohol, acetonitrile, dimethyl formamide, dioxane, acetone, methyl ethyl ketone and methyl isobutyl ketone; the resulting solution is mixed with an aqueous solution containing not only a hydrophilic colloidal substance such as gelatin but also an anionic surfactant such as alkylbenzenesulfonic acid or alkylnaphthalenesulfonic acid and/or a nonionic surfactant such as sorbitan sesquioleic acid ester or sorbitan monolauric acid ester; the mixture is converted to an emulsion or dispersion with a high-speed rotary mixer, colloid mill or ultrasonic disperser; the resulting emulsion or dispersion is incorporated in a coating solution containing a hydrophilic colloidal substance; and the coating solution is applied onto a photographic support or a silver halide emulsion layer formed on said support. Certain oil globule forming compounds may be dissolved in one of the low-boiling organic solvents mentioned above, and the resulting solution may be directly incorporated in the coating solution containing a hydrophilic colloidal substance. When the web is dried, the low-boiling organic solvents evaporate and become substantially absent from the binder.

The "density of the fine oil globules" as used in this specification is defined by the ratio of the total volume of the oil globules to the total volume of the binder incorporated in a specific photographic layer which also contains said oil globules. For the purpose of preventing "bleeding", a lower density of the oil globules is preferred. Therefore, a prior art technique, for example, the one shown in Japanese Patent Publication No. 8346/81, proposes that the density of the oil globules in a photographic material should not exceed 0.8. One feature of the present invention is that even if the density of oil globules is higher than 1, the bleeding can be prevented by using a hardener having three or more functional groups. For the purposes of the present invention, the density of the oil globules should be smaller than 100, preferably smaller than 10.

Various photographic additives may be incorporated in the fine oil globules according to the present invention. Such photographic additives may be hydrophilic or lipophilic, and lipophilic additives are preferred. Illustrative lipophilic additives include oil-soluble couplers, UV absorbers, DIR compounds, anti-stain agents such as hydroquinone derivatives, anti-discoloration agents, and antioxidants.

Oil-soluble couplers that may be incorporated in the oil globules are yellow, magenta and cyan couplers that form color images upon color development. Representative couplers that can be used in the present invention are found in the patents listed below. Suitable yellow couplers are those of benzoyl acetanilide type, pivaloyl acetanilide type or two-equivalent type wherein the carbon atom at a coupling position is substituted by a split-off group that can be eliminated upon coupling reaction. Typical yellow couplers are shown in U.S. Pat. Nos. 2,875,057, 3,265,506, 3,664,841, 3,408,194, 3,447,928, 3,277,155, 3,415,652, Japanese Patent Publication No. 13576/74, and Japanese Patent Applications (OPI) Nos. 29432/73, 66834/73, 10736/74, 122335/74, 28834/75 and 132926/75.

Suitable magenta couplers are 5-pyrazolone, pyrazolotriazole, pyrazolinobenzimidazole, and indazolone couplers, as well as two-equivalent couplers with split-off group. These magenta couplers are shown in, for example, U.S. Pat. Nos. 2,600,788, 3,062,653, 3,127,269, 3,311,476, 3,419,391, 3,519,429, 3,558,318, 3,684,514, 3,888,680, Japanese Patent Applications (OPI) Nos. 29639/74, 111631/74, 129538/74, 13041/75, Japanese Patent Applications Nos. 24690/75, 134470/75, 156327/75, British Pat. No. 1,247,493, Belgian Pat. No. 792,523, U.S. Pat. No. 3,061,432, German Pat. No. 2,156,111, Japanese Patent Publication No. 60479/71 and Belgian Pat. No. 769,116.

Suitable cyan couplers are phenolic and naphtholic couplers, as well as two-equivalent couplers with a split-off group. These cyan couplers are shown in, for example, U.S. Pat. Nos. 2,423,730, 2,474,293, 2,801,171, 2,895,826, 3,476,563, 3,737,326, 3,758,308, 3,893,044, Japanese Patent Applications (OPI) Nos. 37425/72, 10135/75, 25228/75, 112038/75, 117422/75 and 130441/75.

Other couplers that may be incorporated in the oil globules are "wise couplers" that are oil-soluble and which do not form color dyes upon reaction with the oxidation product of a developing agent. More specific examples of the yellow, cyan and magenta couplers are listed below.

Alpha-acyl acetamide yellow-forming cuplers:

Y-1

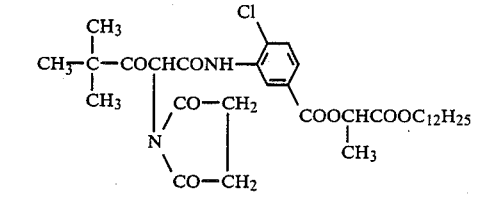

Y-2

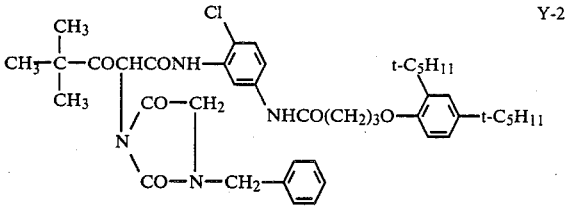

Y-3

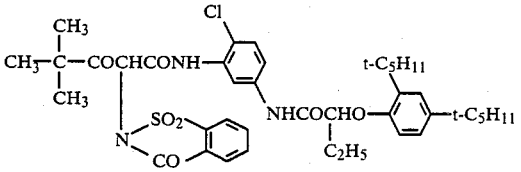

Y-4

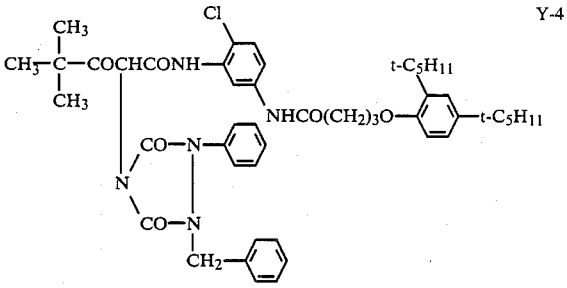

Y-5

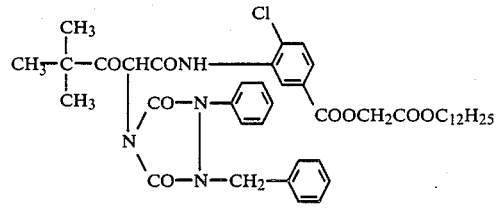

Y-6

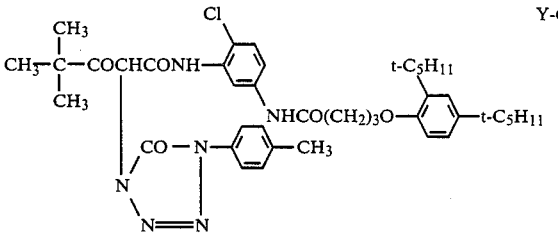

Y-7

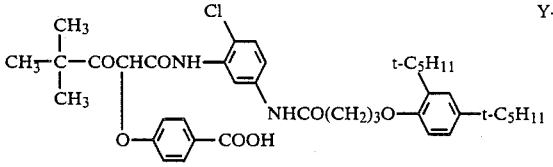

-continued

Y-8

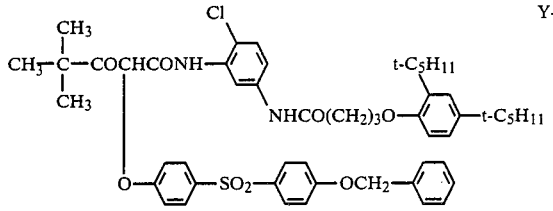

Y-9

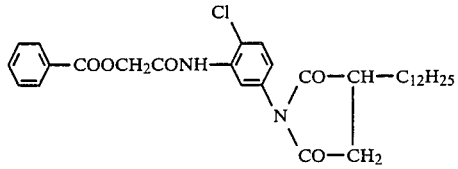

Y-10

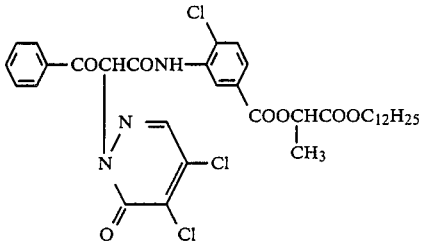

Y-11

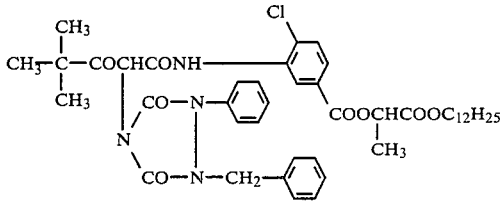

These alpha-acyl acetamide yellow-forming couplers may be synthesized by various methods shown in prior art references, for example, German Patent Applications (OLS) Nos. 2,057,941, 2,163,812, Japanese Patent Applications Nos. 26133/72, 29432/73, U.S. Pat. Nos. 3,227,550, 2,875,057, 3,265,506, Japanese Patent Applications (OPI) Nos. 66834/73, 66835/73, 99432/73, 1229/74, 10736/74, 34232/75, 65231/75, 117423/75, 3631/76 and 50734/76.

One or more of these alpha-acyl acetamide yellow-forming couplers may be incorporated in a silver halide emulsion layer by a conventional procedure. They are incorporated in an amount ranging from $10^{-3}$ to 5, preferably $10^{-2}$ to 0.5 mol, per mole of blue-sensitive silver halide.

Cyan couplers:

C-1

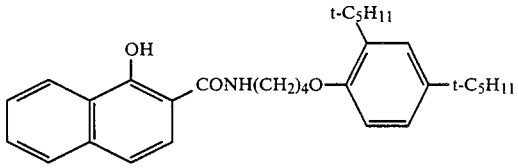

C-2

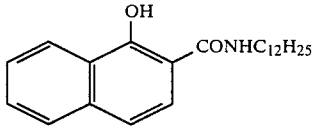

-continued

C-3

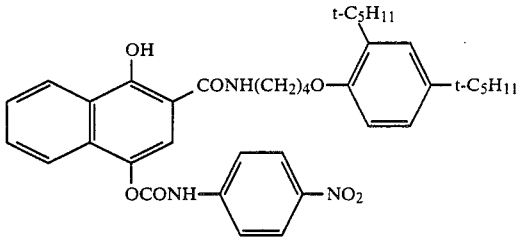

C-4

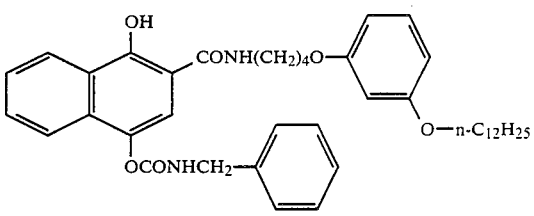

C-5

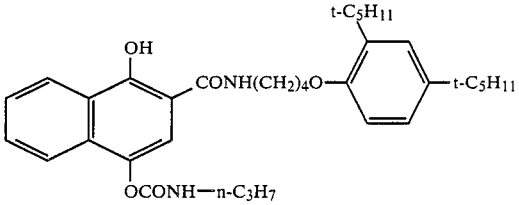

C-6

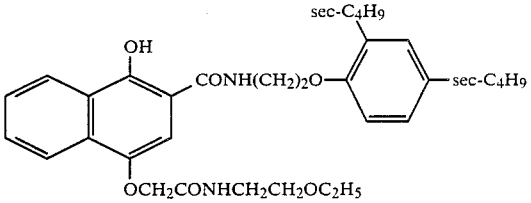

C-7

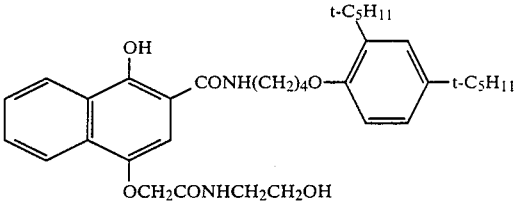

C-8

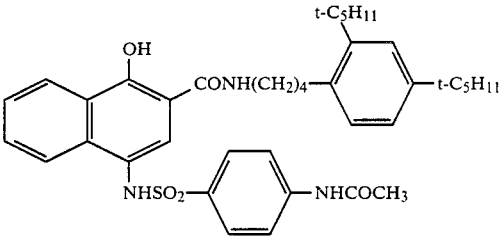

C-9

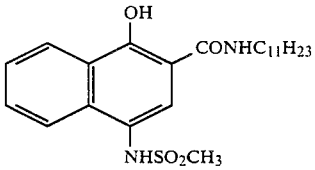

-continued

C-10

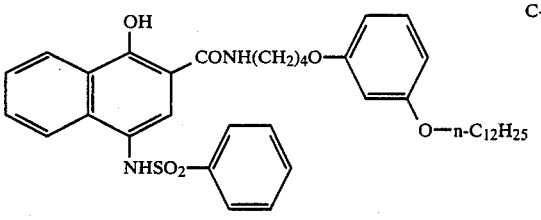

These cyan-forming couplers may be synthesized by any known methods, such as those described in U.K. Pat. No. 1,084,480, Japanese Patent Applications (OPI) Nos. 117422/75, 10135/75, 37647/76, 25228/75 and 130441/75. One or more of these cyan-forming couplers may be incorporated in a silver halide emulsion layer, optionally together with a "colored coupler" (with an arylazo substituent at active site), as shown in U.S. Pat. No. 3,034,892. The cyan-forming couplers can be incorporated by a known procedure in an amount ranging from $10^{-3}$ to 5 mol, preferably $10^{-2}$ to 0.5 mol, per mol or a red-sensitive silver halide.

Magenta couplers:

M-1

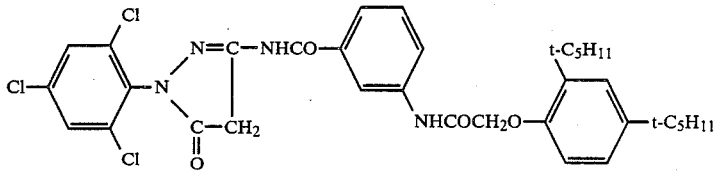

M-2

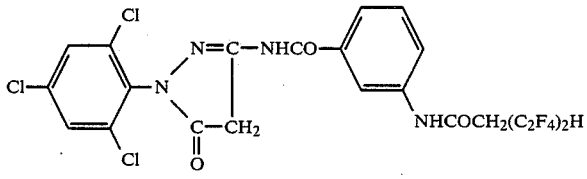

M-3

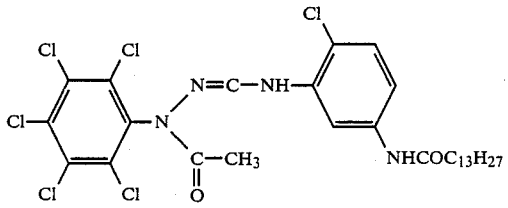

M-4

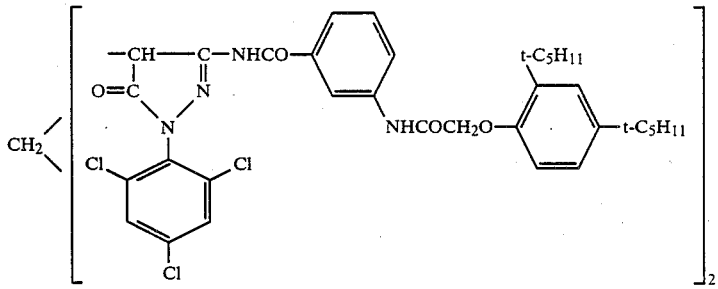

M-5

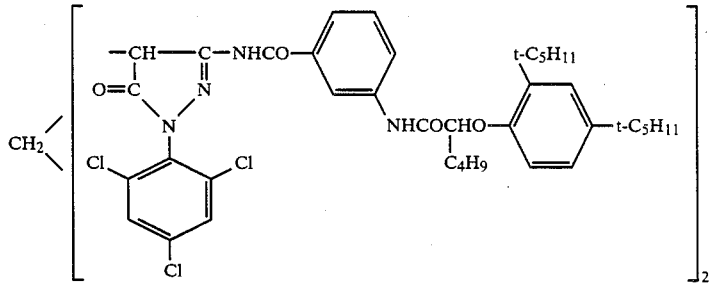

-continued

M-6

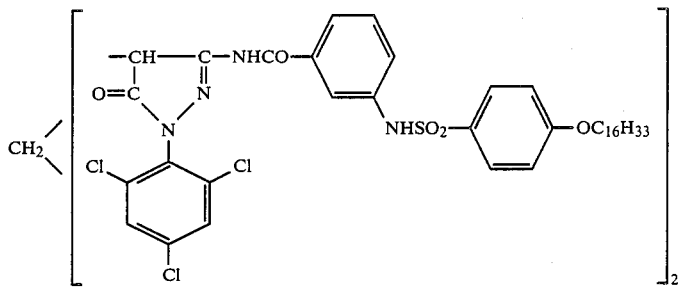

M-7

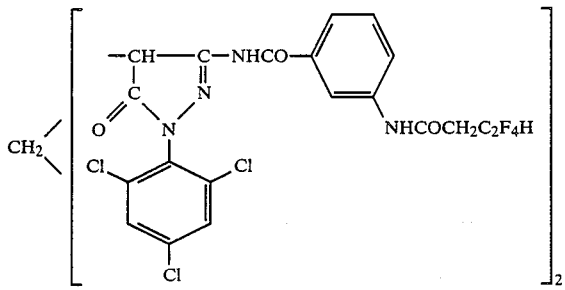

M-8

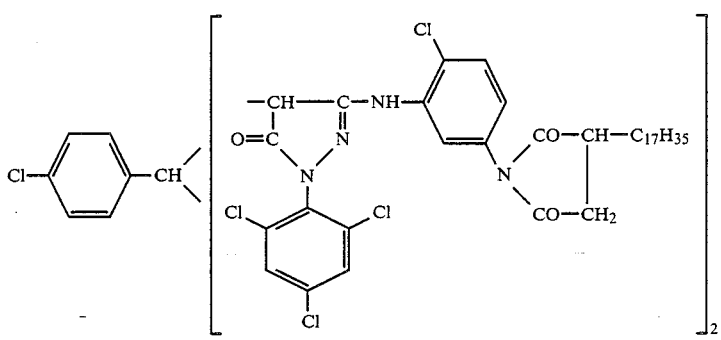

M-9

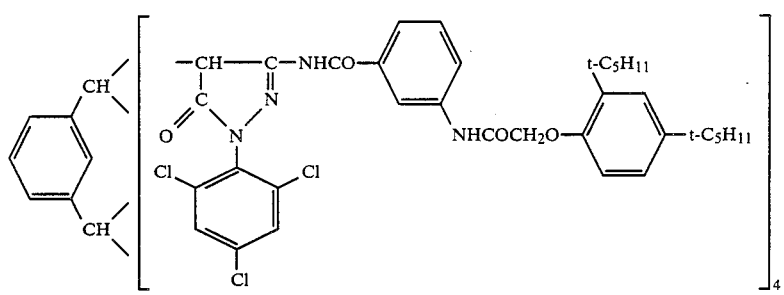

Other suitable magenta couplers are found in many prior art references such as U.S. Pat. Nos. 3,311,476, 3,419,391, 3,888,680, 2,618,641, German Patent Applications (OLS) Nos. 2,015,814, 2,357,102, 2,357,122, Japanese Patent Applications (OPI) Nos. 129538/74, 105820/76, 12555/79, 48540/79, 112342/76, 112343/76, 108842/76 and 58533/77. These references also show the methods for synthesizing the magenta couplers.

One or more of these magenta-forming couplers may be incorporated in a silver halide emulsion layer, optionally together with a colored coupler with an arylazo substituent at active site, as shown in U.S. Pat. No. 3,005,712. They can be incorporated by a known method in an amount ranging from $10^{-3}$ to 5 mol, preferably from $10^{-2}$ to 0.5 mol, per mol of a green-sensitive silver halide.

Ultra-violet absorbers may be incorporated in the oil globules according to the present invention. Suitable UV absorbers include benzotriazoles of the type shown in U.S. Pat. Nos. 3,253,921, 3,004,896, 3,267,113, 3,692,525, U.K. Pat. Nos. 980,886, 1,239,258, 1,256,025, Belgian Pat. Nos. 623,419, 625,007, 670,016, German Pat. No. 2,151,098, and Japanese Patent Publications Nos. 16867/66 and 191779/66; thiazolidones of the type shown in U.S. Pat. Nos. 2,882,150, 2,739,971, 2,798,067, 2,875,053, 3,352,681, 2,739,888, 2,719,162, 2,808,330 and 3,365,295; acrylonitriles of the type shown in Japanese Patent Application (OPI) No. 10537/72, Japanese Patent Publications Nos. 30492/73, 43888/74, 31255/73, 35376/73, and Belgian Pat. No. 833,511; benzophenones of the type shown in U.K. Pat. No. 1,321,355 and U.S. Pat. No. 3,215,530; and those which are described in U.S. Pat. Nos. 3,271,156, 2,748,021, 2,685,512, 2,763,566, 2,632,701, and German Pat. No. 1,023,859.

DIR compounds may also be incorporated in the oil globules, and suitable examples are shown in U.S. Pat. Nos. 3,297,445, 3,364,022, 3,379,529, 3,639,417, 3,958,993, 3,961,956, 3,938,996, 3,928,041, 3,632,345, 3,227,554, 3,773,210, U.K. Pat. No. 2,010,818, Japanese Patent Publication No. 16142/76, Japanese Patent Applications (OPI) Nos. 104630/74, 6724/76, 119631/75, 25337/75, 64927/76, 72433/76, 145135/79, 14513/79, 17644/80, 147716/75, 152731/75, 105819/76, 6724/76, Japanese Patent Applications Nos. 123025/75, 125202/75, and 17644/80.

Anti-stain agents typified by hydroquinone derivatives may also be incorporated in the fine oil globules. Suitable examples of the hydroquinone derivatives are shown in U.S. Pat. Nos. 2,336,327, 2,360,290, 2,384,658, 2,403,721, 2,418,613, 2,675,314, 2,701,197, 2,704,713, 2,710,801, 2,722,556, 2,728,659, 2,732,300, 2,735,765, 2,816,028, 3,062,884, 3,236,893, U.K. Pat. Nos. 557,750, 557,802, German Patent Application (OLS) No. 2,149,789, Japanese Patent Publication No. 54116/69, Japanese Patent Application (OPI) No. 2128/71, and Journal of Organic Chemistry, 22, pp. 772–774.

More specific examples of the hydroquinone derivatives are listed below for illustrative purposes only.

Hq-1
2,5-di-tert-octylhydroquinone
Hq-2
2-tert-octyl-5-methylhydroquinone
Hq-3
2,6-di-n-dodecylhydroquinone
Hq-4
2-n-dodecylhydroquinone
Hq-5
2,2-methylenebis-5,5-di-tert-butylhydroquinone
Hq-6
2,5-di-n-octylhydroquinone
Hq-7
2-dodecylcarbamoylmethylhydroquinone
Hq-8
2-(β-n-dodecyloxycarbonyl)ethylhydroquinone Hq-9
2-(N,N-dibutylcarbamoyl)hydroquinone.

Anti-discoloration agents may also be incorporated in the oil globules, and effective compounds are illustrated in various prior art references such as Japanese Patent Publication Nos. 14034/70, 8338/74, 6208/74, 20977/74, U.S. Pat. Nos. 3,432,300, 3,698,909, 2,360,290, 2,336,327, German Pat. No. 2,008,376, and Japanese Patent Applications Nos. 148929/75, 91917/76 and 94667/76.

According to th present invention, oil globules made of the organic high-boiling compounds may be prepared separately from oil globules made of the lipophilic photographic additives, and the two kinds of oil globules may be respectively incorporated in the coating solution containing the hydrophilic colloid. Oil globules may be prepared from two or more organic high-boiling compounds simultaneously. Alternatively, two or more dispersions of different organic high-boiling compounds may be combined to form oil globules.

For details of the surfactants that can be used as dispersants, see, for example Japanese Patent Publication No. 9979/73, Japanese Patent Applications (OPI) Nos. 134428/75, 3219/76, 32322/76, U.S. Pat. Nos. 2,240,472, 2,271,623, 2,288,226, 2,311,021, 2,322,027, 2,360,289, 2,533,514, 2,739,891, 2,801,170, 2,801,171, 2,852,382, 2,949,360, 3,068,101, 3,158,484, 3,201,253, 3,210,191, 3,294,540, 3,396,027, 2,415,649, 3,441,413, 3,442,654, 3,475,174, 3,545,974, 3,619,195, 3,775,349, German Patent Application (OLS) No. 1,942,665, German Pat. Nos. 1,143,707, 2,045,414, 2,043,271, 2,045,464, as well as U.K. Pat. Nos. 1,077,317 and 1,198,450. One or more compounds can be properly selected from among these surfactants. The amount of the surfactants may be freely adjusted so long as they provide the desired emulsion.

The hardener according to the present invention having at least three functional groups may be incorporated in at least one photographic layer containing the fine oil globules at a density of 1 or more and/or at least one photographic layer position farther from the support than the layer(s) containing said fine oil globules at a density of 1 or higher. Aside from this requirement, there is no limitation on the type and number of the layers in which the hardener can be incorporated. The hardener may even be incorporated in a photographic layer positioned closer to the support than the layer(s) containing the fine oil globules at a density of 1 or more. Therefore, if the fine oil globules are incorporated in the layer which is the farthest from the support, the hardener is incorporated only in said outermost layer. If the fine oil globules are incorporated at a density of 1 or more in two or more layers, the objects of the present invention can be achieved by incorporating the hardener in the oil globule containing layer that is closer to the support than any other oil globule containing layer and/or at least one of the photographic layers positioned farther from the support than these layers. Preferably, the hardener is incorporated in at least one layer selected from among the oil globule containing layer farther from the support than any other oil globule containing layers, and the layers positioned farther from the support than said oil globule containing layers.

The mechanism by which the hardener according to the present invention having at least three functional groups is capable of inhibiting the "bleeding" has not been fully unravelled. A plausible explanation would be that the hardener complicates the matrix structure of the binder such as gelatin and prevents the migration or coalescence of the oil globules in the binder. The amount of this hardener to be added varies with the type of the hardener, as well as the type and physical properties of the binder, and the desired photographic characteristics. Generally, the hardener is incorporated in a photographic layer in an amount of $5\times10^{-7}$ to $2.5\times10^{-3}$ mol per gram of the dry weight of the gelatin in that layer. The preferred range is from $5\times10^{-6}$ to $2.5\times10^{-4}$ mol per gram of the binder. The hardener may be added at any stage of the preparation of the coating solution.

The hardener according to the present invention which has at least three functional groups is a compound having at least three active or reactive sites in the molecule capable of reacting with a hydrophilic colloidal substance, in particular gelatin, used as a binder or which permits the reaction between each gelatin molecule. Advantageous hardener compounds include those which have active vinyl groups as well as those having active halogens. Illustrative hardeners having at least three active vinyl groups are shown in U.S. Pat. No. 3,490,911, Japanese Patent Publication No. 8796/72, and Japanese Patent Applications (OPI) Nos. 24435/74, 44164/76 and 21059/77. Illustrative hardeners having at least three active halogens are listed in Japanese Patent Application (OPI) No. 63062/75. Preferred hardeners having at least three active vinyl groups are those having at least three vinylsulfonyl groups which are represented by the following formula (I): Formula (I)

$$R(SO_2CH{=}CH_2)_n$$

wherein n is an integer of 3 or more, preferably 3 to 6; and R is an aliphatic, aromatic or heterocyclic residual group having an n-valency.

Said aliphatic residual group includes, for example, a hydrocarbon group having 1 to 12 carbon atoms or a hydrocarbon broup having 1 to 12 carbon atoms connected to an atom selected from among oxygen (O), sulfur (S) and nitrogen (N) atoms or to a group selected from among $SO_2$, CO, aromatic and heterocyclic groups. Said aromatic residual group includes, for example, a phenyl or naphthyl group. And said heterocyclic residual group includes a 5 or 6-membered heterocyclic group containing a nitrogen (N), oxygen (O) or sulfur (S) atom such as hexahydrotriazine, piperazine, tetrahydrofuran and imidazolizine.

Those groups may further have substituents such as halogen atom, hydroxyl, carboxyl, sulfonic, nitro, cyano and amino groups. Also, compounds having three or more vinylsulfonyl groups which are produced by reaction of the compound represented by formula (I) with a compound having both a group which reacts with a vinylsulfonyl group and a water-soluble group can be advantageously reused as the hardeners of the present invention. Said group capable of a reaction with the vinylsulfonyl group includes groups such as —SH, =NH, —$NH_2$ and the like, and said water-soluble group includes —OH, —COOH,—$SO_3$, —$SO_3H$, —O-$SO_3H$ and the like or metal salts of these, for example, alkaline metal salts such as Na, K, Li and the like. Specific examples of the compound having a group which reacts with a vinylsulfonyl group are listed in (V-1) to (V-37).

Suitable examples of the hardeners having at least three active halogens include those having formulas (II) and (III), as well as partially hydrolyzed products of the compounds of formula (IV) having at least three active halogens. High-molecular weight hardeners of the type shown in U.S. Pat. Nos. 3,057,723; 3,396,029 and 4,161,407 may also be used as advantageous hardeners.

Formula (II):

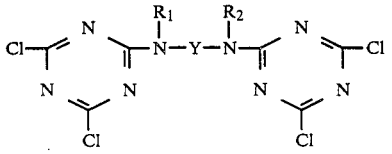

{wherein $R_1$ and $R_2$ are each a hydrogen atom or an alkyl group preferably having 1 to 8 carbon atoms; and Y is an alkylene group having 2 or more carbon atoms preferably having 2 to 8 carbon atoms, a cycloalkylene group preferably having 5 to 8 carbon atoms, a phenylene group, a biphenylene group, a phenyleneoxyphenylene group,{

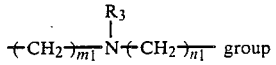

(wherein $R_3$ is a hydrogen atom or an alkyl group preferably having 1 to 8 carbon atoms; and $m_1$ and $n_1$ are each an integer of 2 or 3) or

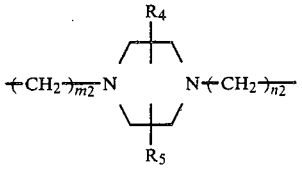

(wherein $R_4$ and $R_5$ are each a hydrogen atom or an alkyl group preferably having 1 to 8 carbon atoms; and $m_2$ and $n_2$ are each an integer of 2 or 3).

Formula (III):

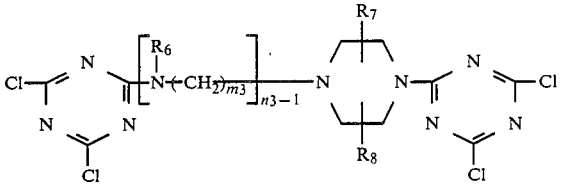

(wherein $R_6$, $R_7$ and $R_8$ are each a hydrogen atom or an alkyl group preferably having 1 to 8 carbon atoms; $m_3$ is an integer of 2 or 3; and $n_3$ is an integer of 1 or 2). Said $R_7$ and $R_8$ may be substituted with a halogen atom, hydroxyl, carboxyl, sulfonic, nitro, cyano or amino group.

Formula (IV):

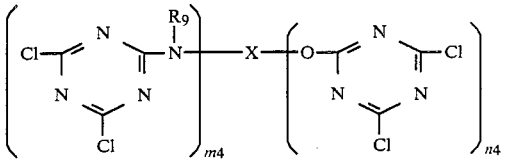

{wherein $m_4$ is 0 or a positive integer preferably of 0 to 5; $n_4$ is a positive integer preferably of 0 to 5; X is an organic residue with a valence of ($m_4+n_4$) preferably phenyl; and $R_9$ is a hydrogen atom or an organic residue which is preferably an alkyl group having 1 to 8 carbon atoms, which may be substituted with a halogen atom, hydroxyl, carboxyl, sulfonic, nitro, cyano or amino group.{.

Specific examples of the hardener that can be used in the present invention are listed below for illustrative purposes only:

$CH_3{-}C(CH_2SO_2CH{=}CH_2)_3$ (I-1)

$C_2H_5{-}C(CH_2SO_2CH{=}CH_2)_3$ (I-2)

$C_8H_{17}{-}C(CH_2SO_2CH{=}CH_2)_3$ (I-3)

$CH_2{=}CHSO_2CH_2{-}CH(SO_2CH{=}CH_2){-}SO_2CH{=}CH_2$ (I-4)

-continued
(I-5)
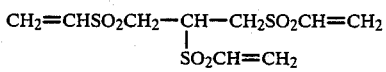
(I-6)
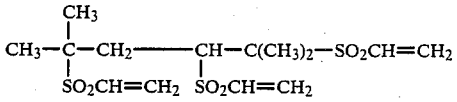
(I-7)
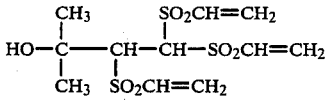
(I-8)
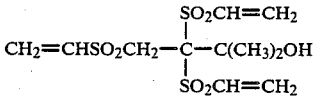
(I-9)
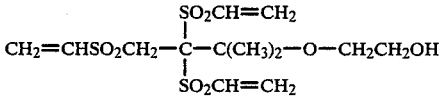
(I-10)
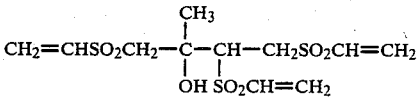
$(CH_2{=}CHSO_2CH_2)_3C{-}CH_2SO_2CH_2CH_2NHCH_2COOH$ (I-11)
(I-12)
$(CH_2{=}CHSO_2CH_2)_3C{-}CH_2SO_2CH_2CH_2NHCH_2COOH$
(I-13)
$(CH_2{=}CHSO_2CH_2)_3C{-}CH_2SO_2CH_2CH_2NHCH_2CH_2SO_3H$
$(CH_2{=}CHSO_2CH_2)_3C{-}CH_2SO_2CH_2CH_2OH$ (I-14)
$(CH_2{=}CHSO_2CH_2)_3C{-}CH_3$ (I-15)
(I-16)
$(CH_2{=}CHSO_2CH_2)_3C{-}CH_2SO_2CH_2CH_2NHCH_2COOC_2H_5$
$(CH_2{=}CHSO_2)_2CH{-}CH(SO_2CH{=}CH_2)_2$ (I-17)
$C(CH_2SO_2CH{=}CH_2)_4$ (I-18)
(I-19)
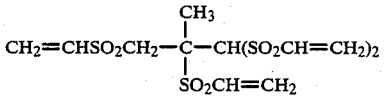
(I-20)
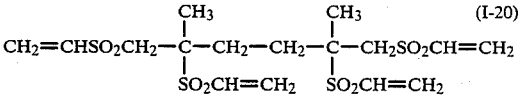
(I-21)
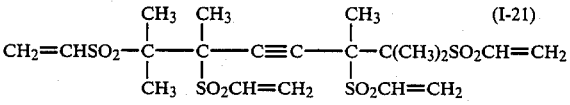
$(CH_2{=}CHSO_2)_2CH{-}CH{-}CH(SO_2CH{=}CH_2)_2$ (I-22)
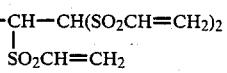
(I-23)
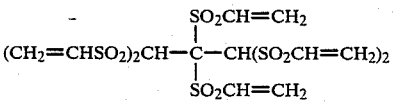
(I-24)
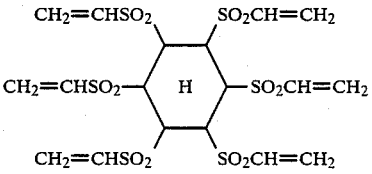
(I-25)
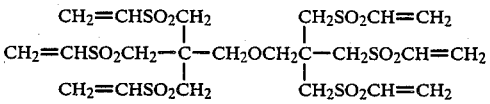
(I-26)
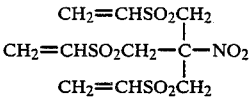
(I-27)
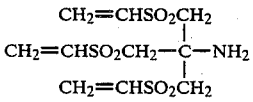
(I-28)
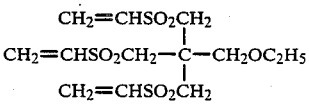
(I-29)
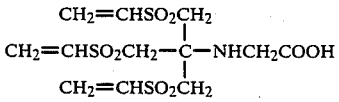
(I-30)
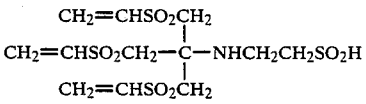
(I-31)
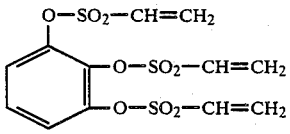
(I-32)
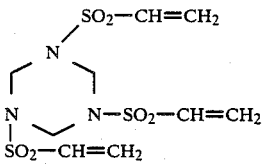

-continued
(I-33)
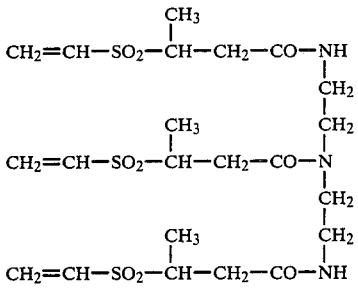
(I-34)
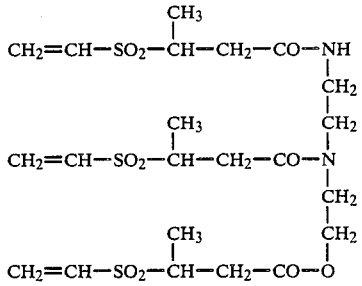
(I-35)
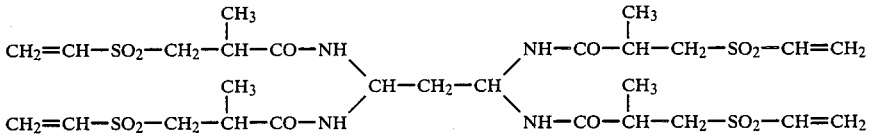
(I-36)
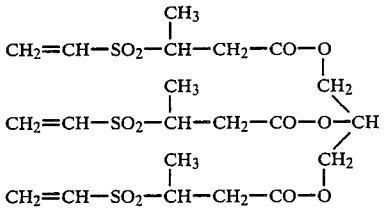
(I-37)
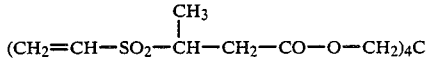
(I-38)
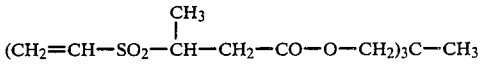
(I-39)
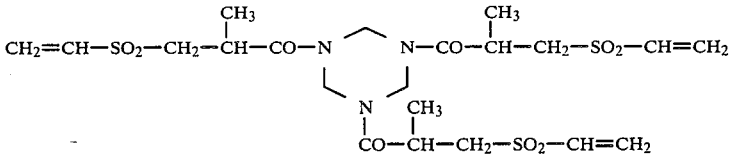
(I-40)
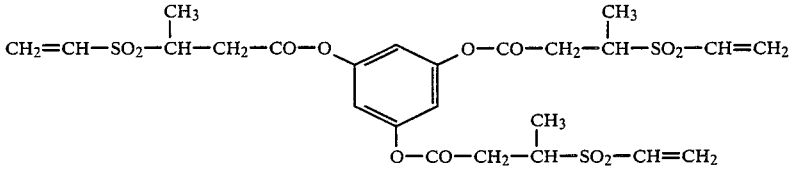
(I-41)
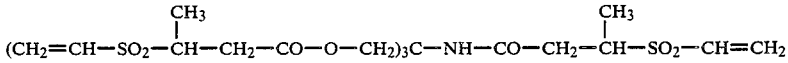
(I-42)
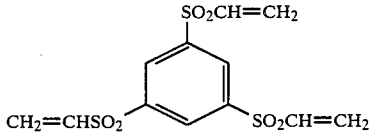
(I-43)
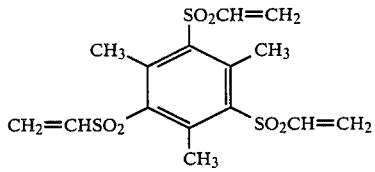
(I-44)
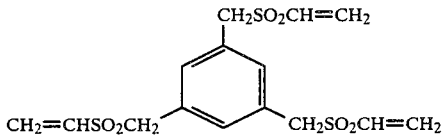
(I-45) $CH_3C(CH_2OCH_2SO_2CH{=}CH_2)_3$
(I-46) $C(CH_2OCH_2SO_2CH{=}CH_2)_4$
(I-47) $N(CH_2CH_2OCH_2SO_2CH{=}CH_2)_3$ -continued
(I-48)
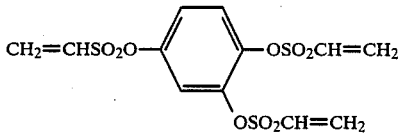
(I-49)
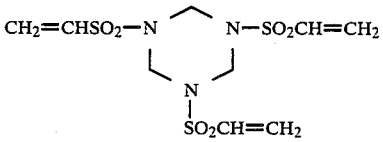
$C_2H_5C(CH_2SO_2CH{=}CH_2)_3$ (I-50)
$C_8H_{17}C(CH_2SO_2CH{=}CH_2)_3$ (I-51)
$CH_2{=}CHSO_2CH_2CH(SO_2CH{=}CH_2)CH_2SO_2CH{=}CH_2$ (I-52)
$(CH_2{=}CHSO_2CH_2)_3CCH_2Br$ (I-53)
$(CH_2{=}CHSO_2CH_2)_2CHCH(CH_2SO_2CH{=}CH_2)_2$ (I-54)
$(CH_2{=}CHSO_2CH_2)_3CCH_2OCH_2C(CH_2SO_2CH{=}CH_2)_3$ (I-55)
$C(CH_2SO_2CH{=}CH_2)_4$ (I-56)
(I-57)
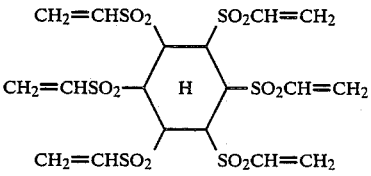
$(CH_2{=}CHSO_2CH_2)_3CCH_2SO_2CH_2CH_2Cl$ (I-58)
(I-59)
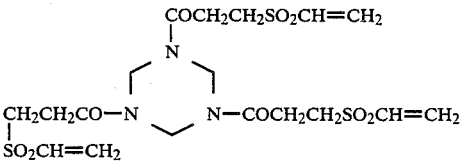
(II-1)
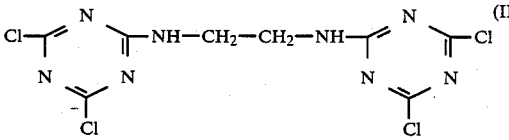
(II-2)
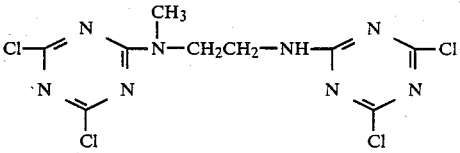
(II-3)
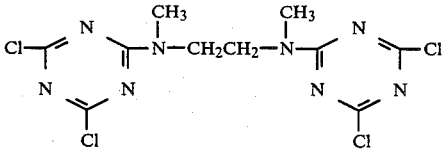
(II-4)
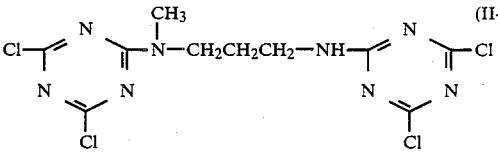
(II-5)
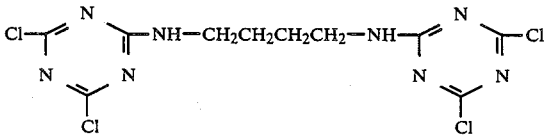
(II-6)
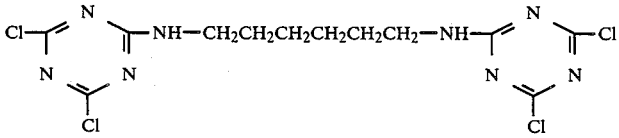
(II-7)
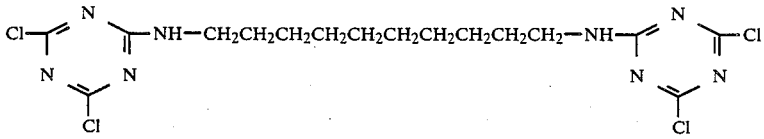

-continued
(II-8)
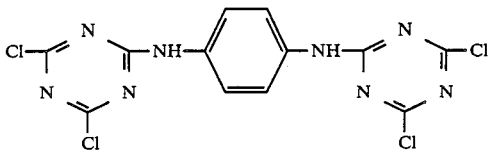
(II-9)
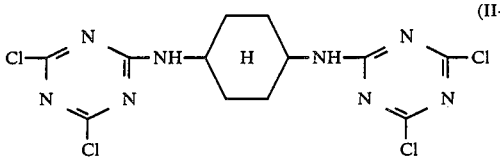
(II-10)
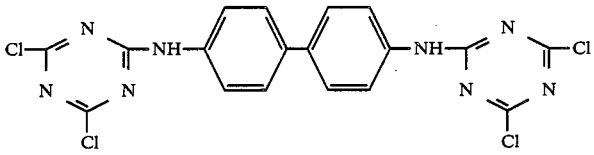
(II-11)
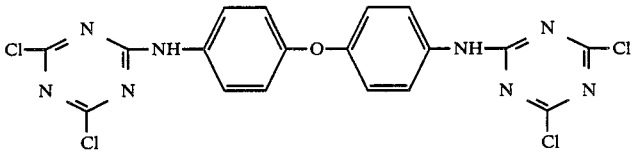
(II-12)
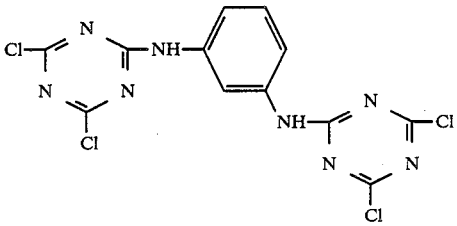
(II-13)
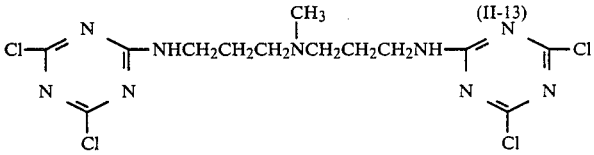
(II-14)
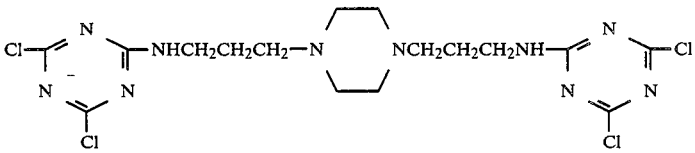
(II-15)
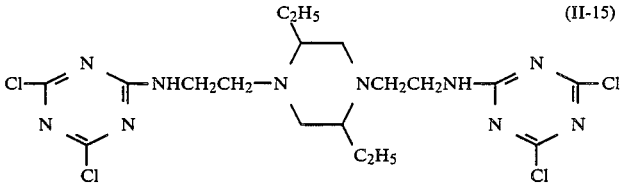
(II-16)
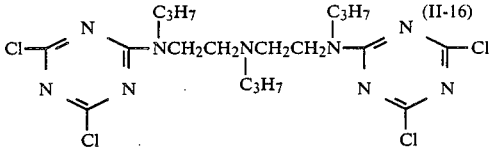
(III-1)
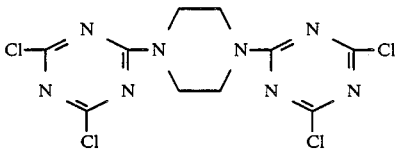
(III-2)
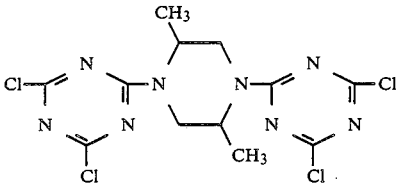
(III-3)
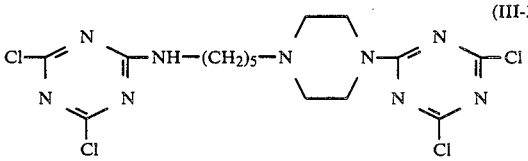
(III-4)
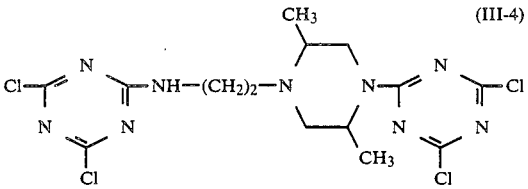

-continued

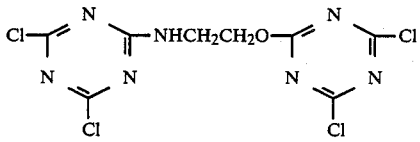
(IV-1)

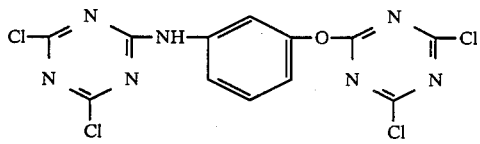
(IV-2)

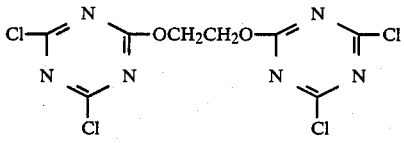
(IV-3)

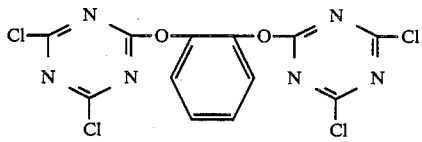
(IV-4)

| | | | |
|---|---|---|---|
| $H_2NCOONa$ | (V-1) | $H_2NSO_3K$ | (V-2) |
| $HSCH_3COOH$ | (V-3) | $HSCH_3COONa$ | (V-4) |
| $HSCH_3COOK$ | (V-5) | $HSCH_2COOLi$ | (V-6) |
| $HSCH_2CH_2COOH$ | (V-7) | $HSCH_2CH_2COOK$ | (V-8) |

(V-9)

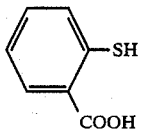

(V-10)

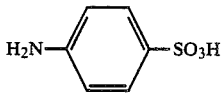

(V-11)

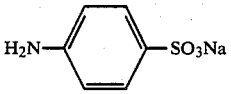

(V-12) $H_2NCH_2CH_2OH$

| | | | |
|---|---|---|---|
| $H_2NCH_2CH_2OSO_3H$ | (V-13) | $H_2NCH_2CH_2OSO_3K$ | (V-14) |
| $H_2NCH_2COOH$ | (V-15) | $H_2NCH_2COONa$ | (V-16) |
| $CH_3NHCH_2COOK$ | (V-17) | $H_2NCH_2SO_3H$ | (V-18) |
| $CH_3NHCH_2SO_3K$ | (V-19) | $H_2NCH_2CH_2SO_3H$ | (V-20) |
| $H_2NCH_2CH_2SO_3K$ | (V-21) | $CH_3NHCH_2CH_2SO_3Na$ | (V-22) |
| $HN(CH_2CH_2OH)_2$ | (V-23) | $HN(CH_2CH_2OSO_3K)_2$ | (V-24) |

$CH_3NHCH_2CH_2CH_2SO_3H$ (V-25)

(V-26)

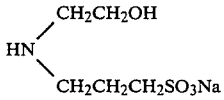

$C_2H_5NHCH_2CH_2CH_2CH_2SO_3H$ (V-27) $C_2H_5NHCH_2CH_2CH_2CH_2SO_3Na$ (V-28)

(V-29)

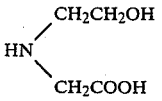

(V-30)

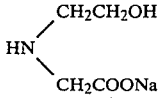

$HN(CH_2COOH)_2$ (V-31)

(V-32)

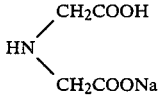

$HN(CH_2COOK)_2$ (V-33) $HSCH_2CHCH_2OH$ (V-34)

$OH$ $HOCH_2CHCH_2OH$ (V-35)

$SH$ (V-36)

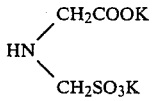

$CH_3NHCH_2COONa$ (V-37)

The above listed hardeners according to the present invention having at least three functional groups may be used either individually or in combination with themselves.

These hardeners may also be used in combination with conventional difunctional hardeners, which include ketone compounds such as diacetyl and dichloropentanedione; compounds having a reactive halogen such as bis(2-chloroethylurea), 2-hydroxy-4,6-dichloro-1,3,5-triazine, and those shown in U.S. Pat. Nos. 3,288,775, 2,732,303 and British Pat. Nos. 974,723 and 1,167,207; divinylsulfone, 5-acetyl-1,3-diacryloylhexahydro-1,3,5-triazine, and those compounds shown in U.S. Pat. Nos. 3,635,718, 3,232,763, 2,732,316, 2,586,168, 3,103,437, 3,117,280, 2,983,611, 2,725,294, 2,725,295, 3,100,704, 3,091,537, 3,321,313 and 3,543,292, as well as British Pat. No. 994,869.

The hydrophilic colloidal substance used as a binder in the present invention is typically made of a gelatin, but gelatin derivatives such as phthalated or malonated gelatin may also be used. If desired, part of these gelatin compounds may be replaced by albumin, agar, gum arabic, alginic acid, casein, partially hydrolyzed cellulose derivatives, polyvinyl alcohol, partially hydrolyzed polyvinyl acetate, polyacrylic acid, polyacrylamide, imidized polyacrylamide, polyvinylpyrrolidone, and copolymers of vinyl compounds.

The photographic material of the present invention may have incorporated therein one or more surfactants for various purposes, such as facilitating the coating application, emulsification, sensitization, improving the photographic characteristics, and preventing static buildup or blocking of the photographic materials. The surfactants that can be used in the present invention are classified into natural surfactants such as saponin; nonionic surfactants such as alkylene oxides, glycerins and glycidols; cationic surfactants such as higher alkylamines, quaternary ammonium salts, pyridine and other hetero compounds, phosphonium and sulfonium compounds; anionic surfactants containing acidic groups such as carboxylic acid, sulfonic acid, phosphoric acid, sulfate ester and phosphate ester groups; and amphoteric surfactants such as amino acids, aminosulfonic acids, and sulfate or phosphate esters of amino alcohols. Several of the compounds that can be used as surfactants are shown in various prior art references: U.S. Pat. Nos. 2,271,623, 2,240,472, 2,288,226, 2,739,891, 3,068,101, 3,158,484, 3,201,253, 3,210,191, 3,294,540, 3,441,413, 3,442,654, 3,475,174, 3,545,974, German Patent Application (OLS) No. 1,942,665, and British Pat. Nos. 1,077,317 and 1,198,450.

The photographic material of the present invention may also contain an organic fluorine containing surfactant. Suitable surfactants include linear or cyclic compounds having at least three fluorine atoms and at least three carbon atoms, and any types of surfactants, i.e. cationic, nonionic, anionic or betaine, may be used with advantage. Typical organic fluorine containing surfactants that can be used in the present invention are shown in, for example, U.S. Pat. Nos. 3,589,906, 3,666,478, 3,754,924, 3,775,126, 3,850,640, British Pat. No. 1,330,356, and Japanese Patent Application No. 31391/75. Anionic organic fluorine containing surfactants are particularly preferred for the purposes of the present invention.

The silver halide photographic material of the present invention may contain a matting agent in the surface protective layer. Suitable matting agents include inorganic materials such as silica, magnesium oxide, titanium dioxide and calcium carbonate, as well as organic materials such as poly(methyl methacrylate), cellulose acetate propionate, and porous, alkali-soluble polymer particles of the type shown in Japanese Patent Application (OPI) No. 135958/76 which are made of acrylic acid and methyl acrylate. The size of the particles generally ranges from about 0.1 to 20 microns, preferably from 0.5 to 10 microns.

The surface protective layer of the photographic material of the present invention may contain colloidal silica. The silver halide emulsion layers and non-sensitive hydrophilic colloidal layers according to the present invention may contain various photographic additives depending upon specific needs.

The silver halide photographic material of the present invention has at least one silver halide emulsion layer formed on a support. Any known techniques may be used for the silver halide emulsion layers, support and optional auxiliary layers such as protective layer, anti-halation layer, filter layer, intermediate layer, and subbing layer.

The silver halides that are incorporated in the silver halide emulsion layers of the photographic material of the present invention have silver halide grains dispersed in the hydrophilic colloid. Suitable silver halides are silver bromide, silver chlorobromide, silver iodobromide and silver chloroiodobromide. These silver halides may be prepared by various methods such as the ammoniacal method, neutral method, acid method, as well as the conversion method and double-jet method described in British Pat. No. 635,841 and U.S. Pat. No. 3,622,318.

The silver halide emulsions may be chemically sensitized by known techniques. Suitable chemical sensitizers include gold compounds such as chloroaurates and auric trichloride of the type shown in U.S. Pat Nos. 2,399,083, 2,540,085, 2,597,856 and 2,597,915; salts of noble metals such as platinum, palladium, iridium, rhodium and ruthenium of the type shown in U.S. Pat. Nos. 2,445,060, 2,540,086, 2,566,245, 2,566,263 and 2,598,079; sulfur compounds that react with silver salts to form silver sulfides, as shown in U.S. Pat. Nos. 1,574,944, 2,410,689, 3,189,458 and 3,501,313; and reducing compound such as stannous salts and amines of the type shown in U.S. Pat. Nos. 2,487,850, 2,518,698, 2,521,925, 2,521,926, 2,694,637, 2,983,610 and 3,201,254.

The silver halide emulsions according to the present invention may be optionally subjected to spectral sensitization or supersensitization by cyanine dyes such as cyanine, merocyanine and carbocyanine used either alone or in combination with themselves or with styryl dyes. Color sensitization techniques are well known and are described in various prior art references such as U.S. Pat. Nos. 2,688,545, 2,912,329, 3,397,060, 3,615,635, 3,628,964, British Pat. Nos. 1,195,302, 1,242,588, 1,293,862, German Patent Applications (OLS) Nos. 2,103,326, 2,121,780, and Japanese Patent Publications Nos. 4936/68 and 14030/69. The proper color sensitization technique may be selected depending upon the specific object and use of the photographic material in consideration of the wavelength range in which the photographic material is to be sensitized and the desired sensitivity.

Various compounds may be incorporated in the photographic emulsions in order to prevent a sensitivity drop or fog from occurring during the manufacture, storage or processing of the photographic material. For this purpose, a great number of compounds are known and they include 4-hydroxy-6-methyl-1,3,3a,7-tetrazaindene, 3-methylbenzothiazole, 1-phenyl-5-mercaptotetrazole, as well as many heterocyclic compounds, mercury containing compounds, mercapto compounds and metal salts.

Preferred examples of the support on which the non-sensitive hydrophilic colloidal layers, silver halide emulsion layers and auxiliary layers are formed include cellulose ester films such as nitrocellulose and acetyl cellulose; polyester films such as polyethylene terephthalate; polyvinyl acetal, polyvinyl chloride, polystyrene and polycarbonate films; baryta paper and polyethylene-coated paper.

The coating method for forming the silver halide emulsion layers and other photosensitive layers must be properly determined in order to ensure uniform quality and high process efficiency. Suitable coating methods are dip coating, double-roll coating, air knife coating, extrusion coating and curtain coating. The extrusion coating and curtain coating are particularly useful because either method permits the simultaneous formation of two or more layers. The coating speed may be selected at any value, but for ensuring high process efficiency, a speed not lower than 30 m/min is preferred. The hardener and other components which are so highly reactive that they form a gel if they remain long in the coating solution are preferably mixed in a static mixer with the coating solution just before the latter is applied to the support.

The photographic material of the present invention has many applications such as black-and-white photography, X-ray photography, printing, microphotography, recording with electron beams, IR recording and color photography.

In order to form an image, the silver halide photographic material of the present invention is first exposed and subsequently developed by a suitable method depending upon its use, i.e. color photography, black-and-white photography, microphotography, lithography or printing paper. The two basic steps of the photographic processing are development and fixation, which may be combined with optional steps such as hardening, stopping, bleaching and stabilization.

Conventional developers may be used in the developing step. They contain a developing agent such as hydroquinone, aminophenol or phenidone. They may optionally contain an alkali agent such as sodium hydroxide or sodium carbonate, a preservative such as sodium sulfite, a pH buffer, a development accelerator, a development retarder and a surfactant.

The fixing solution used in the fixing step contains a solvent for silver halides selected from among thiosulfates such as sodium thiosulfate or ammonium thiosulfate. It may further contain various additives depending upon the case. For the processing of a color photographic material by the negative-positive method, color development, bleaching and fixing are the three basic steps. The processing with the color reversal method consists of development with a black-and-white negative developer, exposure to white light or dipping in a bath containing a foggant, followed by color development, bleaching and fixing. These steps may be performed individually. Alternatively, two or more steps are completed at a time with a multi-functional processing solution. For example, Japanese Patent Publication No. 1885/60 shows a combined color processing using a color developing agent, a ferric salt bleaching component and a thiosulfate fixing component in a single bath, or a combined bleaching and fixing using an ethylenediaminetetraacetic acid iron (III) complex salt bleaching component and a thiosulfate fixing component in a single bath.

If the photographic material of the present invention is used in color photography, it may be processed by any of the known techniques. Typically, it is subjected to color development and bleach-fixing, optionally followed by water rinsing and stabilization, as shown in U.S. Pat. No. 3,582,322; it is subjected to color development and separate steps of bleaching and fixing, optionally followed by water rinsing and stabilization, as shown in U.S. Pat. No. 910,002; it is processed by a sequence of prehardening, neutralization, color development, stop-fixing, water rinsing, bleaching, fixing, water rinsing, post-hardening and water rinsing, as shown in U.S. Pat. No. 3,582,347; it is processed by a sequence of color development, water rinsing, auxiliary color development, stopping, bleaching, fixing, water rinsing and stabilization, as shown in Japanese Patent Application (OPI) No. 54330/75; it is processed by a sequence of prehardening, neutralization, water rinsing, first development, stopping, water rinsing, color development, stopping, water rinsing, bleaching, fixing and water rinsing, as shown in U.S. Pat. No. 3,307,263; it is processed by a sequence of prehardening, neutralization, first development, stopping, water ringing, color developing, stopping, water rinsing, bleaching, rinsing with an organic acid, fixing and water rinsing, as shown in Japanese Patent Application (OPI) No. 36126/75; it is processed by a sequence of first development, bleaching with a nonfixative silver dye, water rinsing, color development, acid rinsing, water rinsing, bleaching, water rinsing, fixing, water rinsing, stabilization and water rinsing, as shown in Japanese Patent Application (OPI) No. 81538/75; it is color developed, and the resulting developed silver is subjected to halogenation bleaching, and another color development is performed to provide an increased amount of dye, as shown in U.S. Pat. Nos. 2,623,822 and 2,814,565; a low-silver photographic material may be processed with the aid of an amplifier such as peroxide or cobalt complex salt, as shown in U.S. Pat. Nos. 3,674,990, 3,761,265, German Patent Application (OLS) No. 2,056,360, Japanese Patent Applications (OPI) Nos. 6338/72 and 10538/72, German Patent Application (OLS) No. 2,226,770, and Japanese Patent Applications (OPI) Nos. 9728/73 and 9729/73. In order to assure rapid processing, these methods may be performed at temperatures higher than 30° C. Room temperature may be used, and in a special case, temperatures lower than 20° C. may be employed. Generally, the temperature range of 20° to 70° C. is selected with advantage. The temperature may be held constant throughout the photographic processing, or different temperatures may be used for different steps.

Typical color developing agents are p-phenylenediamine and aminophenolic compounds, and preferred examples are listed below. 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methoxyethylaniline, 3-methyl-4-amino-N-ethyl-N-β-methanesulfonamidoethylaniline, 3-β-methanesulfonamidoethyl-4-amino-N,N-diethylaniline, 3-methoxyethylamino-N-ethyl-N-β-hydroxyethylaniline, 3-methoxy-4-amino-N-ethyl-N-β-methoxyethylaniline, 3-acetamido-4-amino-N,N-diethylaniline, 4-amino-N,N-dimethylaniline, N-ethyl-N-β-{β-(β-methoxyethoxy)ethoxy}ethyl-3-methyl-4-aminoaniline, N-ethyl-N-β-(β-methoxyethoxy)ethyl-3-4-aminoaniline, as well as salts thereof such as sulfates, hydrochlorides, sulfites and p-toluenesulfonates. Other suitable color developing agents are shown in Japanese Patent Applications (OPI) Nos. 64932/73, 131527/75 and 17246/75, as well as Hent et al., "Journal of American Chemical Society", 73, 3100–3125 (1951).

The color developer may contain various additives depending on the specific need. Typical examples are alkali agents (e.g. hydroxides, carbonates and phosphates of alkali metals and ammonium); pH modifiers or buffers (e.g. weak acids such as acetic acid and boric acid, weak bases and salts thereof); development accelerators (e.g. pyridinium compounds and cationic compounds as shown in U.S. Pat. Nos. 2,648,604 and 3,571,247, potassium nitrate and sodium nitrate, polyethylene glycol condensates and derivatives thereof as shown in U.S. Pat. Nos. 2,533,990, 2,577,127 and 2,950,970, nonionic compounds such as polythioethers of the type shown in British Pat. Nos. 1,020,032 and 1,020,033, polymer compounds having sulfite esters as shown in U.S. Pat. No. 3,068,097, as well as pyridine, ethanolamines, organic amines, benzyl alcohol and hydrazines); antifoggants (e.g. alkali bromides, alkali iodides, nitrobenzimidazoles as shown in U.S. Pat. Nos. 2,496,940 and 2,656,271, mercaptobenzimidazole, 5-methylbenzotriazole, and 1-phenyl-5-mercaptotetrazole, compounds for incorporation in rapid processing solutions as shown in U.S. Pat. Nos. 3,133,864, 3,342,596, 3,295,976, 3,615,522 and 3,597,199, nitrobenzoic acids as shown in Japanese Patent Applicaton (OPI) No. 106832/74, benzothiazolium derivatives as shown in Japanese Patent Application (OPI) No. 1371136/75, phenazine-N-oxides as shown in Japanese Patent Publication No. 41675/71, as well as antifoggants of the type shown in "Handbook on Scientific Photography", vol. 2 of 3 volumes, pp. 29–47); anti-stain or anti-sludge agents as shown in U.S. Pat. Nos. 3,161,513, 3,161,514, British Pat. Nos. 1,030,442, 1,144,481 and 1,251,558; interlayer effect accelerators as shown in U.S. Pat. No. 3,536,487; and preservatives (e.g. sulfites, acidic sulfites, hydroxylamine hydrochlorides, formosulfite and alkanolamine sulfite adducts).

When the photographic material of the present invention is used in color photography, the color development step is followed by bleaching which may be performed in a conventional manner. The bleaching step may be simultaneous with or separate from the fixing step. In the former case, a combined bleach-fixing bath containing both the bleaching and fixing agents is used.

While various compounds may be used as the bleaching agent, preferred examples include potassium ferricyanide, bichromates, iron (III) aminopolycarboxylic acids, metal salts of aliphatic polycarboxylic acids, persulfates, copper complex salts of the type shown in British Pat. Nos. 774,194, 1,032,024, 949,440 and Belgian Pat. No. 717,139, cobalt complex salts of the type shown in German Pat. No. 934,512 and British Pat. No. 777,635, iodine as shown in Japanese Patent Publication No. 11068/66, beaching powder combined with sulfamine as shown in Japanese Patent Publication No. 11068/66, quinones of the type described in U.S. Pat. Nos. 2,507,183, 2,529,981 and 2,748,000, and p-sulfophenylquinones and nitroso compounds of the type shown in U.S. Pat. Nos. 2,625,477 and 2,705,201. These bleaching agents may be used either alone or in combination with themselves.

The bleaching solution or bleach-fixing solution may incorporate bleaching accelerators of the type shown in U.S. Pat. Nos. 3,042,520, 3,241,966, Japanese Patent Publications Nos. 8506/70 and 8336/70, and other suitable additives.

The silver halide photographic material of the present invention is capable of forming an image of good quality, especially high degree of sharpness, without causing "bleeding". Furthermore, the photographic material can be stored in a hot and humid atmosphere without impairing the properties of oil-soluble additives incorporated in the material. Therefore, it ensures the formation of a sharp image even after it is stored in a hot and humid atmosphere for an extended period.

The advantages of the present invention will become more apparent by reading the following examples, to which the embodiments of the invention are by no means limited.

EXAMPLE 1

Eight samples (No. 1–No. 8) of silver halide photographic material were made by forming a blue-sensitive emulsion layer and a protective layer on a subbed triacetyl cellulose base. The respective layers had the compositions indicated below and were applied simultaneously in a superimposed fashion by the slide hopper method.

First layer (Blue-sensitive emulsion layer):

A silver iodobromide emulsion (7.5 mol% silver iodide) was chemically sensitized with gold and sulfur sensitizers. After addition of 4-hydroxy-6-methyl-1,3,3a,7-tetrazaindene (1.0 g), the mixture was processed into a blue-sensitive silver halide emulsion by a conventional method. To 200 g of a yellow coupler (Compound Y-2 shown above), 200 g of dibutyl phthalate and 600 ml of ethyl acetate were added per mol of the silver halide. The mixture was heated to form a solution, which was added to a gelatin solution containing sodium triisopropylnaphthalenesulfonate. The two solutions were agitated in a colloid mill to form an emulsion and the ethyl acetate was removed. The resulting dispersion of fine oil globules was mixed with the previously prepared emulsion to form a blue-sensitive silver halide coating solution. The solution was applied to the triacetyl cellulose base in three different thicknesses, i.e. 5.9μ, 4.8μ and 4.5μ. For the names and amounts of the hardeners that were added just before the application of the coating solution, see Table 1 below.

Second layer (Protective layer):

Coating solutions containing 4 g of gelatin and specific amounts of hardeners (see Table 1) per 100 ml of the solution were applied to the first layer to give a dry thickness of 1.1μ. For the gelatin content of each layer, as well as the amount and densities of oil globules in each layer, see Table 1.

TABLE 1

| | No. 1 | No. 2 | No. 3 | No. 4 | No. 5 | No. 6 | No. 7 | No. 8 |
|---|---|---|---|---|---|---|---|---|
| Protective layer | | | | | | | | |
| Hardener | H-1*[1] | H-1*[1] | H-1*[1] | H-1*[1] | H-1*[1] | H-1*[1] | H-1*[1] | Compound (I-18) |
| Amount (mg/gGel) | 10 mg | 10 mg | 10 mg | 10 mg | 10 mg | 10 mg | 10 mg | 10 mg |
| Gelatin cont. | | | | | 1.5 g/m$^2$ | | | |
| Dry thickness | | | | | 1.1μ | | | |
| Blue-sensitive emulsion layer | | | | | | | | |
| Hardener | H-1 | H-1 | H-1 | Compound (I-2) | Compound (I-2) | Compound (I-2) | Compound (I-18) | H-1 |
| Amount (mg/gGel) | 10 mg | 10 mg | 30 mg | 5 mg | 10 mg | 10 mg | 10 mg | 10 mg |
| Gelatin cont.(g/m$^2$) | 4.5 | 3.0 | 3.0 | 3.0 | 3.0 | 2.5 | 2.5 | 2.5 |
| Amount of oil | 2.6 | 2.6 | 2.6 | 2.6 | 2.6 | 2.6 | 2.6 | 2.6 |

TABLE 1-continued

| | No. 1 | No. 2 | No. 3 | No. 4 | No. 5 | No. 6 | No. 7 | No. 8 |
|---|---|---|---|---|---|---|---|---|
| globules (g/m$^2$) | | | | | | | | |
| Density of oil globules*2 | 0.78 | 1.17 | 1.17 | 1.17 | 1.17 | 1.40 | 1.40 | 1.40 |
| Dry thickness | 5.9μ | 4.8μ | 4.8μ | 4.8μ | 4.8μ | 4.5μ | 4.5μ | 4.5μ |
| Remarks | Comparative sample | Comparative sample | Comparative sample | Sample of the invention | Sample of the invention | Sample of the invention | Sample of the invention | Sample of the invention |

*1H-1: 1,2-divinylsulfonylethane;
*2The density of oil globules was calculated by the following formula:

$$\text{Density of oil globules} = \frac{\text{Amount of oil globules } (g/m^2)/1.0\ (g/cm^3)}{\text{Gelatin content } (g/m^2)/1.35\ (g/cm^3)}$$

Two unexposed test pieces of each sample were prepared (3.5 cm×14 cm). One set of the samples were stored for 7 days in an atmosphere at 55° C. and 80% r.h, and subsequently exposed to blue light in contact with transparent rectangular wave charts. The other set of the samples were immediately exposed to blue light in the same manner. The two exposed sets of samples were processed according to the following schedule so as to produce dye images.

| Processing steps (38° C.) | Time |
|---|---|
| Color development | 3 min. 15 sec. |
| Bleaching | 6 min. 30 sec. |
| Water rinsing | 3 min. 15 sec. |
| Fixing | 6 min. 30 sec. |
| Water rinsing | 3 min. 15 sec. |
| Stabilization | 1 min. 30 sec. |

The respective processing solutions had the following compositions.

Color developer:

| | |
|---|---|
| 4-Amino-3-methyl-N—ethyl-N—(β-hydroxyethyl)-aniline sulfate | 4.75 g |
| Anhydrous sodium sulfite | 4.25 g |
| Hydroxylamine hemisulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| Water to make | 1,000 ml |
| pH | 10.0 |

Bleaching solution:

| | |
|---|---|
| Ethylenediaminetetraacetic acid iron (III) ammonium salt | 100.0 g |

-continued

| | |
|---|---|
| Diammonium ethylenediaminetetraacetate | 10.0 g |
| Ammonium bromide | 150.0 g |
| Glacial acetic acid | 10.0 g |
| Water to make | 1,000 ml |
| pH | 6.0 |

Fixing solution:

| | |
|---|---|
| Ammonium thiosulfate (50% aqueous sol.) | 162 ml |
| Anhydrous sodium sulfite | 12.4 ml |
| Water to make | 1,000 ml |
| pH | 6.5 |

Stabilizing solution:

| | |
|---|---|
| Formalin (37% aqueous sol.) | 5.0 ml |
| Konidax (product of Konishiroku Photo Industry Co., Ltd.) | 7.5 ml |
| Water to make | 1,000 ml |

The turbidities of the color images on the two sets of samples were measured with a nephelometer of Nippon Seimitsu Kogyo K.K. and the results are shown in Table 2. The sharpness of the respective images was also checked and the results are shown in Table 2.

TABLE 2

| | No. 1 | No. 2 | No. 3 | No. 4 | No. 5 | No. 6 | No. 7 | No. 8 |
|---|---|---|---|---|---|---|---|---|
| MTF value (%) 30 line/mm | | | | | | | | |
| Virgin | 79 | 87 | 88 | 87 | 87 | 92 | 94 | 93 |
| After 7-day storage at 55° C., 80% r.h. | 70 | 64 | 65 | 81 | 80 | 84 | 83 | 84 |
| Turbidity (%) | | | | | | | | |
| Virgin | 10 | 9 | 11 | 9 | 9 | 10 | 9 | 9 |
| After 7-day storage at 55° C., 80% r.h. | 20 | 59 | 57 | 15 | 11 | 12 | 11 | 12 |
| Remarks | Comparative sample | Comparative sample | Comparative sample | Sample of the present invention | Sample of the present invention | Sample of the present invention | Sample of the present invention | Sample of the present invention |

The data in Table 2 shows the great improvement achieved by the present invention on the image sharpness and the resistance to bleeding. The hardeners according to the present invention are particularly effective in improving the resistance to bleeding, and as can been seen from the comparison between the results with Samples No. 2 and No. 3, no such effect is achieved by increasing the amount of a hardener outside the scope of the present invention. Comparison between the results with Samples No. 7 and No. 8 show that the resistance to bleeding can be appreciably improved by the hardener of the present invention whether it is incorporated in a layer containing oil globules or in a layer farther from the support than said layer.

EXAMPLE 2

Seventeen samples (Nos. 9 to 25) of high-density multilayer color negative film were prepared by the slide hopper method wherein two or more photographic layers were simultaneously formed on a triacetyl cellulose base in a superimposed fashion and the coatings thus formed were dried, and this cycle of application and drying was repeated to provide a predetermined number of photographic layers.

First Step:

The first layer or an antihalation layer containing black colloidal silver (dry thickness: 1μ) and the second layer or an intermediate gelatin layer containing 2,5-di-tert-octylhydroquinone (dry thickness: 1μ) were simultaneously formed on a subbed triacetyl cellulose base at a speed of 100 m/min, and after drying, the web was taken up by a roll.

Second step:

The third and fourth layers were formed simultaneously on the second layer at a speed of 100 m/min, and after drying, the web was taken up by a roll. The third layer was a red-sensitive silver iodobromide emulsion layer (with 8 mol% silver iodide, dry thickness=6μ) containing $6.8\times10^{-2}$ mol of 1-hydroxy-N-{γ-(2,4-di-tert-amylphenoxy)-butyl}-2-naphthamide as a cyan coupler, $1.7\times10^{-2}$ mol of 1 -hydroxy-N-{δ-(2,4-di-tert-amylphenoxy)-butyl}-4-(2-ethoxycarbonylphenylazo)-2-naphthamide as a colored coupler and $4\times10^{-3}$ mol of 2-(1-phenyl-5-tetrazolylthio)-4-(2,4-di-tert-amylphenoxyacetamido)-1-indanone as a DIR compound, all molar amounts being based on one mol of silver halide. The fourth layer was an intermediate layer having the same composition as that of the second layer.

Third step:

Fifth to eighth layers were formed simultaneously on the fourth layer at a speed of 100 m/min and after drying, the web was taken up by a roll. The fifth layer was a green-sensitive (low sensitivity) silver iodobromide emulsion layer (with 8 mol% silver iodide, dry thickness=4.5 or 3.8μ) containing a dispersion of fine oil globules which was prepared by the following method: $5.8\times10^{-2}$ mol of 1-(2,4,6-trichloro)phenyl-3-{3-(2,4-di-tert-amylphenoxy)acetamido}benzamido-5-pyrazolone as a magenta coupler, $1.7\times10^{-2}$ mol of 1-(2,4,6-trichlorophenyl)-3-{3-(octadecenylsuccinimido)-2-chloro}anilide-4-(γ-naphthylazo)-5-pyrazolone as a colored coupler, and $7\times10^{-5}$ mol of 2-(1-phenyl-5-tetrazolylthio)-4-(2,4-di-tert-amylphenoxyacetamido)-1-indanone as a DIR compound, all molar amounts being based on one mol of silver halide, were dissolved in a mixture of tricresyl phosphate (60 g) and ethyl acetate (180 ml) under heating. The solution was added to a gelatin solution containing sodium triisopropylnaphthalenesulfonate. The two solutions were stirred in a colloid mill to form a dispersion of fine oil globules, from which the ethyl acetate was subsequently removed. The sixth layer was a green-sensitive (high sensitivity) silver iodobromide emulsion layer (with 6 mol% of silver iodide, dry thickness=2.0 or 2.5μ) containing a dispersion of fine oil globules which was prepared by the following method: $1.1\times10^{-2}$ mol of a magenta coupler, $5\times10^{-3}$ mol of a colored coupler and $2\times10^{-5}$ mol of a DIR compound (all molar amounts being based on one mol of silver halide) which were respectively the same as those used in preparing the fifth layer were dissolved in a mixture of tricresyl phosphate (20 g) and ethyl acetate (40 ml) under heating. The resulting solution was added to a gelatin solution containing sodium triisopropylnaphthalenesulfonate and the two solutions were stirred in a colloid mill to form a dispersion of fine oil globules, from which the ethyl acetate was subsequently removed. The seventh layer was an intermediate layer having the same composition as that of the second layer. The eighth layer was a gelatin layer (dry thickness: 1μ) containing yellow colloidal silver and 2,5-di-tert-octylhydroquinone. In each sample, the respective layers contained the oil globules in the amounts and densities indicated in Table 3. For the types and amounts of the hardeners used in the respective samples, also see Table 3.

Fourth step:

A blue-sensitive (high sensitivity) silver halide emulsion (from which to make a ninth layer) was prepared by a conventional method which comprised first sensitizing silver iodobromide grains (average size: 1.4μ, with 7.5 mol% silver iodide) with gold and sulfur sensitizers and then adding 4-hydroxy-6-methyl-1,3,3a,7-tetrazaindene (1.0 g) to the chemically sensitized grains. To 200 g of a yellow coupler (Y-23), a mixture of dibutyl phthalate (160 g) and ethyl acetate (480 ml) was added and the mixture was heated to form a solution. The solution was added to an aqueous gelatin solution containing sodium triisopropyl naphthalenesulfonate and the two solutions were stirred in a colloid mill to form an emulsion of fine oil globules, from which the ethyl acetate was subsequently removed. The resulting dispersion was added to the previously prepared silver halide emulsion.

To 2-{3-cyano-3-(n-dodecylaminocarbonyl)allylidene}-1-ethylpyrrolidine (2 g), a mixture of di-2-ethylhexylphthalate (2 g) and ethyl acetate (2 ml) was added and the resulting mixture was heated to form a solution. The solution was added to an aqueous gelatin solution containing sodium triisopropyl naphthalenesulfonate (0.6 g) and the two solutions were stirred to form a dispersion. This dispersion provided a coating solution for the tenth layer or a protective layer. It was applied simultaneously with the previously prepared coating solution for the ninth layer at a speed of 100 m/min. The dry thicknesses of the ninth and tenth layers for each sample are indicated in Table 3. For the hardeners incorporated in the respective layers, also see Table 3. Two sets of samples, one being stored at 55° C. and 80% r.h. for 7 days and the other being virgins, were processed as in Example 1, and the turbidity and sharpness of the color image formed on each of the samples were evaluated by the same method as in Example 1. The results are shown in Table 4, which also lists the fog densities for the respective samples as measured with a Macbeth densitometer.

TABLE 3

| | | Sample No. | | | | | |
|---|---|---|---|---|---|---|---|
| | | 9 | 10 | 11 | 12 | 13 | 14 |
| Protective | Hardener | H-1 | H-1 | H-1 | I-1 | H-1 | I-13 |

TABLE 3-continued

| | | | | | | | |
|---|---|---|---|---|---|---|---|
| layer | Gelatin cont. (g/m$^2$) | 2.0 | 2.0 | 2.0 | 2.0 | 0.27 | 0.27 |
| | Density of oil globules | 0.34 | 0.34 | 0.34 | 0.34 | 2.5 | 2.5 |
| | Dry thickness (μ) | 2.0 | 2.0 | 2.0 | 2.0 | 0.7 | 0.7 |
| Blue-sensitive emulsion layer (high sensitivity) | Hardener | H-1 | H-1 | I-11 | I-11 | H-1 | H-1 |
| | Gelatin cont. (g/m$^2$) | 4.7 | 3.3 | 3.3 | 3.3 | 4.7 | 4.7 |
| | Density of oil globules | 0.86 | 1.23 | 1.23 | 1.23 | 0.86 | 0.86 |
| | Dry thickness (μ) | 6.5 | 5.4 | 5.4 | 5.4 | 6.5 | 6.5 |
| Yellow filter layer | Gelatin cont. (g/m$^2$) | 1.1 | 1.1 | 1.1 | 1.1 | 1.1 | 1.1 |
| | Density of oil globules | 0.25 | 0.25 | 0.25 | 0.25 | 0.25 | 0.25 |
| | Dry thickness (μ) | 1.0 | 1.0 | 1.0 | 1.0 | 1.0 | 1.0 |
| Intermediate layer | Gelatin cont. (g/m$^2$) | 1.1 | 1.1 | 1.1 | 1.1 | 1.1 | 1.1 |
| | Density of oil globules | 0.25 | 0.25 | 0.25 | 0.25 | 0.25 | 0.25 |
| | Dry thickness (μ) | 1.0 | 1.0 | 1.0 | 1.0 | 1.0 | 1.0 |
| Green-sensitive emulsion layer (high sensitivity) | Hardener | H-1 | H-1 | H-1 | H-1 | H-1 | H-1 |
| | Gelatin cont. (g/m$^2$) | 2.0 | 2.0 | 2.0 | 2.0 | 2.0 | 2.0 |
| | Density of oil globules | 0.67 | 0.67 | 0.67 | 0.67 | 0.67 | 0.67 |
| | Dry thickness (μ) | 2.5 | 2.5 | 2.5 | 2.5 | 2.5 | 2.5 |
| Green-sensitive emulsion layer (low sensitivity) | Hardener | H-1 | H-1 | H-1 | H-1 | H-1 | H-1 |
| | Gelatin cont. (g/m$^2$) | 3.4 | 3.4 | 3.4 | 3.4 | 3.4 | 3.4 |
| | Density of oil globules | 0.80 | 0.80 | 0.80 | 0.80 | 0.80 | 0.80 |
| | Dry thickness (μ) | 4.5 | 4.5 | 4.5 | 4.5 | 4.5 | 4.5 |
| | | Comparative sample | Comparative sample | Sample of the present invention | Sample of the present invention | Comparative sample | Sample of the present invention |
| | | 15 | 16 | 17 | 18 | 19 | 20 |
| Protective layer | Hardener | I-13 | I-13 | H-1 | I-18 | I-33 | I-39 |
| | Gelatin cont. (g/m$^2$) | 0.27 | 0.27 | 2.0 | 0.27 | 0.27 | 0.27 |
| | Density of oil globules | 2.5 | 2.5 | 0.34 | 2.5 | 2.5 | 2.5 |
| | Dry thickness (μ) | 0.7 | 0.7 | 2.0 | 0.7 | 0.7 | 0.7 |
| Blue-sensitive emulsion layer (high sensitivity) | Hardener | I-13 | H-1 | I-18 | I-18 | I-33 | I-39 |
| | Gelatin cont. (g/m$^2$) | 3.3 | 4.7 | 4.7 | 3.3 | 3.3 | 3.3 |
| | Density of oil globules | 1.23 | 0.86 | 0.86 | 1.23 | 1.23 | 1.23 |
| | Dry thickness (μ) | 5.4 | 6.5 | 6.5 | 5.4 | 5.4 | 5.4 |
| Yellow filter layer | Gelatin cont. (g/m$^2$) | 1.1 | 1.1 | 1.1 | 1.1 | 1.1 | 1.1 |
| | Density of oil globules | 0.25 | 0.25 | 0.25 | 0.25 | 0.25 | 0.25 |
| | Dry thickness (μ) | 1.0 | 1.0 | 1.0 | 1.0 | 1.0 | 1.0 |
| Intermediate layer | Gelatin cont. (g/m$^2$) | 1.1 | 1.1 | 1.1 | 1.1 | 1.1 | 1.1 |
| | Density of oil globules | 0.25 | 0.25 | 0.25 | 0.25 | 0.25 | 0.25 |
| | Dry thickness (μ) | 1.0 | 1.0 | 1.0 | 1.0 | 1.0 | 1.0 |
| Green-sensitive emulsion layer (high sensitivity) | Hardener | H-1 | H-1 | H-1 | I-18 | I-33 | I-39 |
| | Gelatin cont. (g/m$^2$) | 2.0 | 0.68 | 0.68 | 0.68 | 0.68 | 0.68 |
| | Density of oil globules | 0.67 | 2.0 | 2.0 | 2.0 | 2.0 | 2.0 |
| | Dry thickness (μ) | 2.5 | 2.0 | 2.0 | 2.0 | 2.0 | 2.0 |
| Green-sensitive emulsion layer (low sensitivity) | Hardener | H-1 | H-1 | H-1 | I-18 | I-33 | I-39 |
| | Gelatin cont. (g/m$^2$) | 3.4 | 3.4 | 3.4 | 2.4 | 2.4 | 2.4 |
| | Density of oil globules | 0.80 | 0.80 | 0.80 | 1.11 | 1.11 | 1.11 |
| | Dry thickness (μ) | 4.5 | 4.5 | 4.5 | 3.8 | 3.8 | 3.8 |
| | | Sample of the present invention | Sample of the present invention | Sample of the present invention | Sample of the present invention | Sample of the present invention | Sample of the present invention |
| | | 21 | 22 | 23 | 24 | 25 | General |
| Protective layer | Hardener | I-42 | I-46 | I-56 | I-56 | I-56 | Amount of hardener: 10.0 mg/gGel Amount of oil globules 0.5 g/m$^2$ |
| | Compound (V) | V-23 | V-7 | V-37 | V-21 | V-23 | |
| | Gelatin cont. (g/m$^2$) | 0.27 | 0.27 | 0.27 | 0.27 | 0.27 | |
| | Density of oil globules | 2.5 | 2.5 | 2.5 | 2.5 | 2.5 | |
| | Dry thickness (μ) | 0.7 | 0.7 | 0.7 | 0.7 | 0.7 | |
| Blue-sensitive emulsion layer (high sensitivity) | Hardener | I-42 | I-46 | I-56 | I-56 | I-56 | Amount of hardener: 10.0 mg/gGel Amount of oil globules: 3.0 g/m$^2$ |
| | Compound (V) | V-23 | V-7 | V-37 | V-21 | V-23 | |
| | Gelatin cont. (g/m$^2$) | 3.3 | 3.3 | 3.3 | 3.3 | 3.3 | |
| | Density of oil globules | 1.23 | 1.23 | 1.23 | 1.23 | 1.23 | |
| | Dry thickness (μ) | 5.4 | 5.4 | 5.4 | 5.4 | 5.4 | |
| Yellow filter layer | Gelatin cont. (g/m$^2$) | 1.1 | 1.1 | 1.1 | 1.1 | 1.1 | Amount of oil globules: 0.2 g/m$^2$ |
| | Density of oil globules | 0.25 | 0.25 | 0.25 | 0.25 | 0.25 | |
| | Dry thickness (μ) | 1.0 | 1.0 | 1.0 | 1.0 | 1.0 | |
| Intermediate layer | Gelatin cont. (g/m$^2$) | 1.1 | 1.1 | 1.1 | 1.1 | 1.1 | Amount of oil globules: 0.2 g/m$^2$ |
| | Density of oil globules | 0.25 | 0.25 | 0.25 | 0.25 | 0.25 | |
| | Dry thickness (μ) | 1.0 | 1.0 | 1.0 | 1.0 | 1.0 | |
| Green-sensitive emulsion layer (high sensitivity) | Hardener | I-42 | I-46 | I-56 | I-56 | I-56 | Amount of hardener: 10.0 mg/gGel Amount of oil globules: 1.0 g/m$^2$ |
| | Compound (V) | V-23 | V-7 | V-37 | V-21 | V-23 | |
| | Gelatin cont. (g/m$^2$) | 0.68 | 0.68 | 0.68 | 0.68 | 0.68 | |
| | Density of oil globules | 2.0 | 2.0 | 2.0 | 2.0 | 2.0 | |
| | Dry thickness (μ) | 2.0 | 2.0 | 2.0 | 2.0 | 2.0 | |
| Green-sensitive | Hardener | I-42 | I-46 | I-56 | I-56 | I-56 | Amount of hardener: |
| | Compound (V) | V-23 | V-7 | V-37 | V-21 | V-23 | |

TABLE 3-continued

| | | | | | | | |
|---|---|---|---|---|---|---|---|
| emulsion layer (low sensitivity) | Gelatin cont. (g/m$^2$) | 2.4 | 2.4 | 2.4 | 2.4 | 2.4 | 10.0 mg/gGel |
| | Density of oil globules | 1.11 | 1.11 | 1.11 | 1.11 | 1.11 | Amount of oil |
| | Dry thickness ($\mu$) | 3.8 | 3.8 | 3.8 | 3.8 | 3.8 | globules: 2.0 g/m$^2$ |
| | | Sample of the present invention | Sample of the present invention | Sample of the present invention | Sample of the present invention | Sample of the present invention | |

TABLE 4

| | | 9 | 10 | 11 | 12 | 13 | 14 | 15 | 16 | 17 | 18 |
|---|---|---|---|---|---|---|---|---|---|---|---|
| MTF value (%) | | | | | | | | | | | |
| 10 lines/mm | | | | | | | | | | | |
| B | Virgin | 100 | 106 | 107 | 107 | 104 | 106 | 110 | 104 | 100 | 110 |
| | After 7-day storage at 55° C., 80% r.h. | 98 | 90 | 103 | 105 | 102 | 102 | 108 | 102 | 98 | 109 |
| G | Virgin | 92 | 99 | 99 | 98 | 94 | 94 | 102 | 100 | 98 | 107 |
| | After 7-day storage at 55° C., 80% r.h. | 88 | 85 | 95 | 94 | 90 | 90 | 98 | 95 | 94 | 104 |
| 30 lines/mm | | | | | | | | | | | |
| B | Virgin | 60 | 67 | 68 | 67 | 65 | 67 | 75 | 65 | 60 | 75 |
| | After 7-day storage at 55° C., 80% r.h. | 58 | 51 | 65 | 65 | 62 | 64 | 73 | 63 | 59 | 73 |
| G | Virgin | 48 | 55 | 55 | 55 | 50 | 51 | 59 | 57 | 55 | 63 |
| | After 7-day storage at 55° C., 80% r.h. | 44 | 40 | 51 | 50 | 46 | 46 | 55 | 52 | 51 | 60 |
| 50 lines/mm | | | | | | | | | | | |
| B | Virgin | 40 | 50 | 49 | 49 | 45 | 46 | 59 | 45 | 40 | 60 |
| | After 7-day storage at 55° C., 80% r.h. | 37 | 30 | 46 | 46 | 42 | 43 | 56 | 42 | 38 | 58 |
| G | Virgin | 32 | 39 | 38 | 38 | 35 | 35 | 43 | 41 | 39 | 45 |
| | After 7-day storage at 55° C., 80% r.h. | 28 | 25 | 34 | 34 | 31 | 31 | 39 | 36 | 35 | 42 |
| Turbidity | Virgin | 10 | 10 | 11 | 11 | 11 | 11 | 11 | 11 | 11 | 10 |
| | After 7-day storage at 55° C., 80% r.h. | 19 | 70 | 17 | 15 | 65 | 20 | 18 | 20 | 18 | 20 |
| Density by Macbeth densiometer | | | | | | | | | | | |
| B | Virgin | 0.65 | 0.65 | 0.65 | 0.65 | 0.65 | 0.65 | 0.65 | 0.65 | 0.65 | 0.65 |
| | After 7-day storage at 55° C., 80% r.h. | 0.75 | 0.90 | 0.75 | 0.75 | 0.77 | 0.77 | 0.75 | 0.75 | 0.74 | 0.74 |
| G | Virgin | 0.41 | 0.41 | 0.41 | 0.41 | 0.41 | 0.41 | 0.41 | 0.41 | 0.41 | 0.41 |
| | After 7-day storage at 55° C., 80% r.h. | 0.52 | 0.60 | 0.50 | 0.50 | 0.50 | 0.52 | 0.50 | 0.52 | 0.52 | 0.50 |

| | | 19 | 20 | 21 | 22 | 23 | 24 | 25 |
|---|---|---|---|---|---|---|---|---|
| MTF Value (%) | | | | | | | | |
| 10 lines/mm | | | | | | | | |
| B | Virgin | 110 | 111 | 110 | 111 | 109 | 110 | 110 |
| | After 7-day storage at 55° C., 80% r.h. | 109 | 109 | 110 | 110 | 110 | 110 | 110 |
| G | Virgin | 106 | 107 | 107 | 107 | 106 | 106 | 106 |
| | After 7-day storage at 55° C., 80% r.h. | 104 | 103 | 104 | 103 | 104 | 103 | 103 |
| 30 lines/mm | | | | | | | | |
| B | Virgin | 74 | 76 | 75 | 75 | 75 | 75 | 75 |
| | After 7-day storage at 55° C., 80% r.h. | 73 | 73 | 75 | 75 | 75 | 75 | 75 |
| G | Virgin | 62 | 62 | 62 | 63 | 62 | 63 | 63 |
| | After 7-day storage at 55° C., 80% r.h. | 60 | 58 | 59 | 59 | 59 | 59 | 59 |
| 50 lines/mm | | | | | | | | |
| B | Virgin | 61 | 59 | 58 | 60 | 61 | 61 | 60 |
| | After 7-day storage at 55° C., 80% r.h. | 59 | 56 | 46 | 59 | 60 | 60 | 59 |
| G | Virgin | 46 | 46 | 46 | 45 | 46 | 46 | 46 |
| | After 7-day storage at 55° C., 80% r.h. | 44 | 42 | 43 | 41 | 44 | 43 | 43 |
| Turbidity | Virgin | 11 | 10 | 10 | 11 | 10 | 9 | 11 |
| | After 7-day storage at 55° C., 80% r.h. | 19 | 20 | 20 | 20 | 20 | 20 | 20 |
| Density by Macbeth densitometer | | | | | | | | |
| B | Virgin | 0.65 | 0.65 | 0.65 | 0.65 | 0.65 | 0.65 | 0.65 |
| | After 7-day storage at 55° C., 80% r.h. | 0.74 | 0.75 | 0.74 | 0.74 | 0.74 | 0.74 | 0.74 |
| G | Virgin | 0.41 | 0.41 | 0.41 | 0.41 | 0.41 | 0.41 | 0.41 |
| | After 7-day storage at 55° C., 80% r.h. | 0.50 | 0.50 | 0.50 | 0.50 | 0.50 | 0.50 | 0.50 |

In Samples No. 21 to No. 25, hardeners of formula (I) were used. They were prepared by reacting compounds (I) with (V) in the molar ratios indicated in the following table.

| Sample No. | I | V | |
|---|---|---|---|
| 21 | I-42: | V-23 = | 1:1.1 |
| 22 | I-46: | V-7 = | 1:2 |
| 23 | I-56: | V-37 = | 1:1.2 |
| 24 | I-56: | V-21 = | 1:0.75 |

-continued

| Sample No. | I | V | |
|---|---|---|---|
| 25 | I-56: | V-23 = | 1:1.5 |

As Table 4 shows, the present invention achieves a significant improvement in the image sharpness without causing bleeding on the surface. If the hardeners according to the present invention are incorporated in emulsion layers, they bring about an unexpected result:

the sensitometric characteristics also change for the better (i.e. small increase in the fog density).

What is claimed is:

1. A silver halide photographic material having as essential photographic layers at least one photosensitive silver halide emulsion layer and at least one nonsensitive hydrophilic colloidal layer on a support, at least one of said photographic layers containing fine oil globules at a density in the range of 1 to 100, and a hardener having at least three functional groups being incorporated in at least one photographic layer containing said fine oil globules and/or at least one photographic layer which is farther from said support than the photographic layer containing said fine oil globules, wherein the combination of said hardener and said density of 1 to 100 is effective to provide said silver halide photographic material with improved image sharpness and reduced bleeding.

2. A silver halide photographic material according to claim 1, wherein the density of said fine oil globules is in the range of 1 to 10.

3. A silver halide photographic material according to claim 1, wherein the density of said fine oil globules is in the range of 1 to 3.

4. A silver halide photographic material according to claim 1, wherein the functional groups of said hardener are active vinyl groups or active halogen atoms.

5. A silver halide photographic material according to claim 4, wherein said active vinyl groups are vinylsulfonyl groups.

6. A silver halide photographic material according to claim 1, wherein said hardener is represented by the following formula (I):

Formula (I):

$$R(SO_2CH{=}CH_2)_n$$

(wherein R is an aliphatic, aromatic or heterocyclic residual group having an n-valency; and n is an integer of 3 or more.)

7. A silver halide photographic material according to claim 6, wherein the aliphatic residual group represented by R in said formula (I) is a hydrocarbon group having 1 to 12 carbon actoms or a hydrocarbon group having 1 to 12 carbon atoms connected to an atom selected from among oxygen (O), sulfur (S) and nitrogen (N) atoms or to a group selected from among $SO_2$, CO, aromatic and heterocyclic groups.

8. A silver halide photographic material according to claim 6, wherein the aromatic residual group represented by R in said formula (I) is a phenyl or naphthyl group.

9. A silver halide photographic material according to claim 6, wherein the heterocyclic residual group represented by R in said formula (I) is selected from the group consisting of hexahydrotriazine, piperazine, tetrahydrofuran and imidazolizine.

10. A silver halide photographic material according to claim 7, wherein the heterocyclic residual group represented by R in said formula (I) is selected from the group consisting of hexahydrotriazine, piperazine, tetrahydrofuran and imidazolizine.

11. A silver halide photographic material according to claim 1, wherein the functional groups of said hardener are active halogen atoms.

12. A silver halide photographic material according to claim 11, wherein said hardener is a hardener represented by the following formula (II) or (III) or a partially hydrolyzed product of the compound represented by the following formula (IV):

Formula (II):

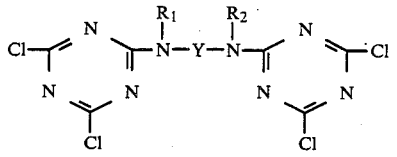

{wherein $R_1$ and $R_2$ are each a hydrogen atom or an alkyl group; and Y is an alkylene group having 2 or more carbon atoms, a cycloalkylene group, a phenylene group, a biphenylene group, a phenyleneoxyphenylene group,

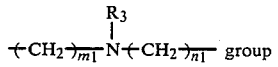

(wherein $R_3$ is hydrogen atom or an alkyl group; and $m_1$ and $n_1$ are each an integer of 2 or 3) or

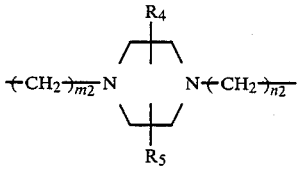

(wherein $R_4$ and $R_5$ are each a hydrogen atom or an alkyl group; and $m_2$ and $n_2$ are each an integer of 2 or 3}.

Formula (III):

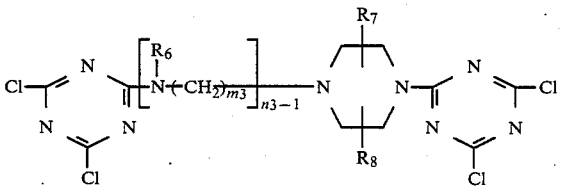

(wherein $R_6$, $R_7$ and $R_8$ are each a hydrogen atom or an alkyl group; $m_3$ is an integer of 2 or 3; and $n_3$ is an integer of 1 or 2).

Formula (IV):

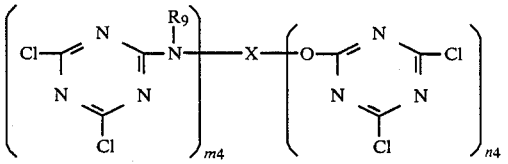

{wherein $m_4$ is O or a positive integer; $n_4$ is a positive integer; X is an organic residue with a valence of $(m_4+n_4)$; and $R_9$ is a hydrogen atom or an organic residue}.

13. A silver halide photographic material according to claim 1, wherein said photographic layer is a photosensitive silver halide emulsion layer containing fine oil globules.

* * * * *